US010287642B2

(12) United States Patent
Scott

(10) Patent No.: US 10,287,642 B2
(45) Date of Patent: May 14, 2019

(54) ANIMAL SKIN SUBSTRATE TREATMENT APPARATUS AND METHOD

(71) Applicant: Xeros LTD, Rotherham, South Yorkshire (GB)

(72) Inventor: Iain Alexander Scott, Rotherham (GB)

(73) Assignee: Xeros Limited, Rotherham (GB)

( * ) Notice: Subject to any disclaimer, the term of this patent is extended or adjusted under 35 U.S.C. 154(b) by 98 days.

(21) Appl. No.: 15/510,569

(22) PCT Filed: Oct. 8, 2015

(86) PCT No.: PCT/GB2015/052942
§ 371 (c)(1),
(2) Date: Mar. 10, 2017

(87) PCT Pub. No.: WO2016/055789
PCT Pub. Date: Apr. 14, 2016

(65) Prior Publication Data

US 2017/0240981 A1 Aug. 24, 2017

(30) Foreign Application Priority Data

Oct. 10, 2014 (GB) ..... 1418006.1

(51) Int. Cl.
*C14C 15/00* (2006.01)
*C14B 1/00* (2006.01)
(Continued)

(52) U.S. Cl.
CPC ..... *C14C 15/00* (2013.01); *C14B 1/00* (2013.01); *C14C 3/00* (2013.01); *D06P 1/00* (2013.01); *D06P 3/32* (2013.01)

(58) Field of Classification Search
CPC .. C14B 1/00; C14C 15/00; C14C 3/00; D06P 3/32; D06P 1/00
See application file for complete search history.

(56) References Cited

U.S. PATENT DOCUMENTS 3,591,326 A 7/1971 Johnels
3,806,412 A 4/1974 Gagne et al.
(Continued)

FOREIGN PATENT DOCUMENTS

AU 702280 B2 2/1999
CA 868968 A 4/1971
(Continued)

OTHER PUBLICATIONS

U.S. Appl. No. 15/518,047, Xeros Ltd.
(Continued)

*Primary Examiner* — Eisa B Elhilo
(74) *Attorney, Agent, or Firm* — Clark & Elbing LLP

(57) ABSTRACT

The invention relates to an improved method and apparatus for the treatment of animal skin substrates which employs a multiplicity of solid particles. There is disclosed an apparatus for treating one or more animal skin substrates with a multiplicity of solid particles and treatment liquor comprising: a rotatably mounted drum comprising an internal volume having a first portion defining a treatment volume for retaining said animal substrates and a second portion defining a collecting volume; one or more inlets for introducing solid particles and treatment liquor into said treatment volume; a partition separating said treatment volume from said collecting volume wherein said partition allows free passage of solid particles from the treatment volume to the collecting volume and prevents the passage of the substrates therethrough; a circulation path for conveying said solid particles from the collecting volume to the treatment volume; and a pumping device arranged to pump solid particles and said treatment liquor along a portion of said circulation path.

63 Claims, 2 Drawing Sheets

(51) Int. Cl.

| | |
|---|---|
| ***D06P 1/00*** | (2006.01) |
| ***C14C 3/00*** | (2006.01) |
| ***D06P 3/32*** | (2006.01) |

(56) References Cited

U.S. PATENT DOCUMENTS

| | | | |
|---|---|---|---|
| 4,221,564 | A | 9/1980 | Plapper et al. |
| 4,272,242 | A | 6/1981 | Plapper et al. |
| 5,709,714 | A | 1/1998 | Natoli et al. |
| 6,237,373 | B1 | 5/2001 | Harris et al. |
| 8,118,942 | B2 | 2/2012 | Featherson et al. |
| 8,959,961 | B2 | 2/2015 | Jenkins et al. |
| 8,974,545 | B2 | 3/2015 | Burkinshaw et al. |
| 9,017,423 | B2 | 4/2015 | Burkinshaw et al. |
| 9,121,000 | B2 | 9/2015 | Burkinshaw et al. |
| 9,127,882 | B2 | 9/2015 | Jenkins et al. |
| 9,297,107 | B2 | 3/2016 | Jenkins |
| 9,315,766 | B2 | 4/2016 | He et al. |
| 9,404,210 | B2 | 8/2016 | He et al. |
| 9,410,278 | B2 | 8/2016 | He et al. |
| 9,476,155 | B2 | 10/2016 | He et al. |
| 9,487,898 | B2 | 11/2016 | He et al. |
| 9,523,169 | B2 | 12/2016 | Sawford et al. |
| 9,550,966 | B2 | 1/2017 | Burkinshaw et al. |
| 9,587,337 | B2 | 3/2017 | He et al. |
| 9,587,340 | B2 | 3/2017 | Jenkins et al. |
| 9,631,314 | B2 | 4/2017 | Yin et al. |
| 9,803,307 | B2 | 10/2017 | Jenkins et al. |
| 9,834,881 | B2 | 12/2017 | Sawford et al. |
| 9,845,516 | B2 | 12/2017 | Steele |
| 9,850,455 | B2 | 12/2017 | Jenkins et al. |
| 9,850,619 | B2 | 12/2017 | Wells et al. |
| 9,914,901 | B2 | 3/2018 | Burkinshaw et al. |
| 9,932,700 | B2 | 4/2018 | Wells et al. |
| 10,017,895 | B2 | 7/2018 | Wells et al. |
| 10,081,900 | B2 | 9/2018 | Wells et al. |
| 2004/0045092 | A1 | 3/2004 | Cassingham |
| 2005/0229354 | A1 | 10/2005 | Dinteman et al. |
| 2006/0101584 | A1 | 5/2006 | Hueffer et al. |
| 2008/0111269 | A1 | 5/2008 | Politi et al. |
| 2008/0251356 | A1 | 10/2008 | Bratusa et al. |
| 2009/0205142 | A1 | 8/2009 | Vorlander et al. |
| 2011/0296628 | A1 | 12/2011 | Jenkins et al. |
| 2012/0048299 | A1 | 3/2012 | Jenkins et al. |
| 2012/0284931 | A1* | 11/2012 | Jenkins ..... D06F 23/025 8/137 |
| 2012/0304400 | A1 | 12/2012 | Jenkins et al. |
| 2013/0167882 | A1 | 7/2013 | Burkinshaw et al. |
| 2013/0276242 | A1 | 10/2013 | Jenkins et al. |
| 2013/0283542 | A1 | 10/2013 | Jenkins et al. |
| 2013/0340487 | A1 | 12/2013 | Yin et al. |
| 2014/0123399 | A1 | 5/2014 | Reiners et al. |
| 2014/0189961 | A1 | 7/2014 | He et al. |
| 2014/0201929 | A1 | 7/2014 | He et al. |
| 2014/0317860 | A1 | 10/2014 | He et al. |
| 2015/0027173 | A1 | 1/2015 | Wu et al. |
| 2015/0096128 | A1 | 4/2015 | Sawford et al. |
| 2015/0096129 | A1 | 4/2015 | Sawford et al. |
| 2015/0128358 | A1 | 5/2015 | Wells et al. |
| 2015/0148278 | A1 | 5/2015 | Burkinshaw et al. |
| 2015/0152357 | A1 | 6/2015 | Abercrombie et al. |
| 2015/0175945 | A1 | 6/2015 | Waddon et al. |
| 2015/0252511 | A1 | 9/2015 | Roberts et al. |
| 2016/0032522 | A1 | 2/2016 | Steele |
| 2016/0040260 | A1 | 2/2016 | Steele |
| 2016/0122932 | A1 | 5/2016 | Wells et al. |
| 2016/0122936 | A1 | 5/2016 | Wells et al. |
| 2016/0195409 | A1 | 7/2016 | Goldberg et al. |
| 2016/0197998 | A1 | 7/2016 | Carleo |
| 2016/0251602 | A1 | 9/2016 | Steele et al. |
| 2016/0251603 | A1 | 9/2016 | Steele et al. |
| 2016/0251795 | A1 | 9/2016 | Wells et al. |
| 2017/0051447 | A1 | 2/2017 | He et al. |
| 2017/0137983 | A1 | 5/2017 | He et al. |
| 2017/0159222 | A1 | 6/2017 | Jenkins et al. |
| 2017/0240980 | A1 | 8/2017 | Feyisa et al. |
| 2017/0240982 | A1 | 8/2017 | Sadeghi |
| 2017/0241061 | A1 | 8/2017 | Wells et al. |
| 2017/0247771 | A1 | 8/2017 | Scott |
| 2017/0267949 | A1 | 9/2017 | Bird et al. |
| 2018/0057777 | A1 | 3/2018 | Waddon et al. |
| 2018/0127914 | A1 | 5/2018 | Wells et al. |
| 2018/0134994 | A1 | 5/2018 | Steele et al. |
| 2018/0141089 | A1 | 5/2018 | Sawford et al. |
| 2018/0216049 | A1 | 8/2018 | Bird et al. |

FOREIGN PATENT DOCUMENTS

| | | | |
|---|---|---|---|
| CN | 2310074 | Y | 3/1999 |
| CN | 101360837 | A | 2/2009 |
| CN | 102061589 | A | 5/2011 |
| CN | 202175862 | U | 3/2012 |
| CN | 102425053 | A | 4/2012 |
| CN | 102425055 | A | 4/2012 |
| CN | 202214631 | U | 5/2012 |
| CN | 202214633 | U | 5/2012 |
| CN | 202298219 | U | 7/2012 |
| CN | 202298220 | U | 7/2012 |
| CN | 202298222 | U | 7/2012 |
| CN | 202298235 | U | 7/2012 |
| CN | 202323458 | U | 7/2012 |
| CN | 202359387 | U | 8/2012 |
| CN | 202359388 | U | 8/2012 |
| CN | 202359389 | U | 8/2012 |
| CN | 202359390 | U | 8/2012 |
| CN | 202359396 | U | 8/2012 |
| CN | 202492706 | U | 10/2012 |
| CN | 202543634 | U | 11/2012 |
| CN | 202543635 | U | 11/2012 |
| CN | 202543646 | U | 11/2012 |
| CN | 202543652 | U | 11/2012 |
| CN | 102899848 | A | 1/2013 |
| CN | 202688698 | U | 1/2013 |
| CN | 202755220 | U | 2/2013 |
| CN | 202755221 | U | 2/2013 |
| CN | 102953249 | A | 3/2013 |
| CN | 102953250 | A | 3/2013 |
| CN | 102953262 | A | 3/2013 |
| CN | 102978870 | A | 3/2013 |
| CN | 103061084 | A | 4/2013 |
| CN | 103061085 | A | 4/2013 |
| CN | 103061086 | A | 4/2013 |
| CN | 103061087 | A | 4/2013 |
| CN | 103087839 | A | 5/2013 |
| CN | 103103720 | A | 5/2013 |
| CN | 103103721 | A | 5/2013 |
| CN | 103122566 | A | 5/2013 |
| CN | 103122567 | A | 5/2013 |
| CN | 202913242 | U | 5/2013 |
| CN | 202989172 | U | 6/2013 |
| CN | 103225192 | A | 7/2013 |
| CN | 203049283 | U | 7/2013 |
| CN | 103361934 | A | 10/2013 |
| CN | 103361938 | A | 10/2013 |
| CN | 203370359 | U | 1/2014 |
| CN | 102061588 | B | 2/2014 |
| CN | 103556439 | A | 2/2014 |
| CN | 203530695 | U | 4/2014 |
| CN | 203530700 | U | 4/2014 |
| CN | 203530714 | U | 4/2014 |
| CN | 203530718 | U | 4/2014 |
| CN | 203530723 | U | 4/2014 |
| CN | 203530725 | U | 4/2014 |
| CN | 103285643 | B | 4/2015 |
| CN | 103451894 | B | 11/2015 |
| CN | 103556434 | B | 11/2015 |
| CN | 103556436 | B | 11/2015 |
| CN | 103556431 | B | 1/2016 |
| CN | 103556432 | B | 3/2016 |
| CN | 105420992 | A | 3/2016 |
| CN | 105420993 | A | 3/2016 |
| CN | 105421000 | A | 3/2016 |
| CN | 105442267 | A | 3/2016 |
| CN | 205329373 | U | 6/2016 |

(56) References Cited

FOREIGN PATENT DOCUMENTS

| | | | |
|---|---|---|---|
| CN | 205329374 | U | 6/2016 |
| CN | 205329380 | U | 6/2016 |
| CN | 205329384 | U | 6/2016 |
| EP | 0439108 | A1 | 7/1991 |
| EP | 0306236 | B1 | 4/1993 |
| GB | 498506 | A | 1/1939 |
| GB | 874232 | A | 8/1961 |
| GB | 1186368 | A | 4/1970 |
| GB | 1332999 | A | 10/1973 |
| GB | 1481508 | A | 8/1977 |
| GB | 2287953 | A | 10/1995 |
| JP | H01318100 | A | 12/1989 |
| JP | H09-512573 | A | 12/1997 |
| JP | 2003017457 | A | 1/2003 |
| JP | 2009148699 | A | 7/2009 |
| RO | 98565 | B1 | 3/1999 |
| RU | 2206619 | C1 | 6/2003 |
| SU | 720020 | A1 | 3/1980 |
| WO | WO-88/10317 | A1 | 12/1988 |
| WO | WO-02/12569 | A1 | 2/2002 |
| WO | WO-2004/061136 | A1 | 7/2004 |
| WO | WO-2007/128962 | A1 | 11/2007 |
| WO | WO-2009/153345 | A2 | 12/2009 |
| WO | WO-2010/094959 | A1 | 8/2010 |
| WO | WO-2011/064581 | A1 | 6/2011 |
| WO | WO-2011/098815 | A1 | 8/2011 |
| WO | WO-2011/128676 | A1 | 10/2011 |
| WO | WO-2012/056252 | A2 | 5/2012 |
| WO | WO-2012/095677 | A2 | 7/2012 |
| WO | WO-2014/080192 | A1 | 5/2014 |
| WO | WO-2014/147391 | A1 | 9/2014 |

OTHER PUBLICATIONS

U.S. Appl. No. 15/532,137, Xeros Ltd.
U.S. Appl. No. 15/414,314, He et al.
U.S. Appl. No. 15/510,576, Xeros Ltd.
U.S. Appl. No. 15/513,014, Xeros Ltd.
U.S. Appl. No. 15/513,309, Xeros Ltd.
Afsar et al., "An investigation about the effect of oxazolidine on modified valonia extract tanning," African Journal of Biotechnology. 7(20):3737-42 (2008).
International Search Report and Written Opinion for International Application No. PCT/GB2015/052942, dated Jan. 14, 2016 (8 pages).
Jing et al., "A novel oxazolidine tanning agent and its use in vegetable combination tanning," The Journal of the Society of Leather Technologists and Chemists 95(4):165-70 (2011).
Musa et al., "Studies on combination tanning based on henna and oxazolidine," The Journal of the American Leather Chemist's Association 104(10):335-43 (2009).
Search Report for United Kingdom Application No. GB1418006.1, dated May 1, 2015 (4 pages).
U.S. Appl. No. 16/093,449, Xeros Ltd.
U.S. Appl. No. 16/093,433, Xeros Ltd.
U.S. Appl. No. 16/093,398, Xeros Ltd.
Hudson et al, "Leather coloration," Rev. Prog. Coloration. 30: 67-75 (2000).

* cited by examiner

ANIMAL SKIN SUBSTRATE TREATMENT APPARATUS AND METHOD

This invention relates to an improved method and apparatus for the treatment of animal skin substrates which employs a solid particulate material (also referred to herein as "a multiplicity of solid particles"). Particularly, the invention provides a method and apparatus for separating the solid particulate material from the animal skin substrates during the treatment process. In preferred embodiments, the animal skin substrates can be a hide or a pelt. The animal skin substrates can be subjected to one or more processes to form leather.

BACKGROUND

Current methods for treating or processing animal skin substrates can necessitate the use of vast quantities of water. For example, in treatment methods wherein the animal skin substrate comprises a hide, typically 30 kg of water is required per kg of hide. Large volumes of water can be needed in order to remove unwanted materials from the animal skin (such as those that are liable to decomposition) and also in subsequent steps of the process which involve chemical modification to confer certain properties on the substrate. Chemical modification of the substrate can be carried out for the purpose of, inter alia, preserving, waterproofing, colouring and/or providing any desired textural or aesthetic qualities. The various steps described above will generally be performed in the presence of a treatment formulation comprising one or more components.

Due to the large amounts of water relative to the weight of animal substrate, current treatment processes known in the art also require a proportionate quantity of chemicals used in the treatment formulation to ensure an effective treatment of the substrate within an acceptable timeframe. Consequently, excessive amounts of polluting and environmentally damaging effluents can be produced from such processes. Furthermore, long process times are necessary.

Many of the methods for preparing animal skin substrates for human use still remain predominantly based on traditional processes and there have been few advances in recent years. For example, methods for the processing and manufacturing of leather have remained largely unchanged for 75 years. EP0439108 filed in 1991 and directed to a process using carbon dioxide for deliming of hides, discloses an example of one of the few recent developments in this field.

Prior to the innovations disclosed herein, the inventors have previously addressed the problem of reducing water consumption in a domestic or industrial cleaning method. Thus, in WO-A-2007/128962 there is disclosed a method and formulation for cleaning a soiled substrate, the method comprising the treatment of the moistened substrate with a formulation comprising a multiplicity of polymeric particles, wherein the formulation is free of organic solvents. The soiled substrate may be wetted so as to achieve a substrate to water ratio of between 1:0.1 to 1:5 w/w, and optionally, the formulation may additionally comprise at least one cleaning material, which typically comprises a surfactant, which most preferably has detergent properties. The soiled substrate may comprise a textile fibre. The polymeric particles may, for example, comprise particles of polyamides, polyesters, polyalkenes, polyurethanes or their copolymers, a particular example being nylon beads.

Following the development of this method the present applicant further devised an apparatus specially adapted to clean soiled substrates by virtue of recirculation of the polymeric particles. Thus, in WO2011/098815, the present applicant provided an apparatus for use in the cleaning of soiled substrates, the apparatus comprising housing means having a first upper chamber with a rotatably mounted cylindrical cage mounted therein and a second lower chamber located beneath the cylindrical cage, and additionally comprising at least one recirculation means, access means, pumping means and a multiplicity of delivery means, wherein the rotatably mounted cylindrical cage comprises a drum having perforated side walls where up to 60% of the surface area of the side walls comprises perforations comprising holes having a diameter of no greater than 25.0 mm.

Although the method and apparatus disclosed in WO2007/128962 and WO2011/098815 provided considerable improvements for the cleaning of soiled substrates these developments were primarily applicable to the field of laundry wherein the substrate typically comprises textile fibre garments. The method and apparatus of WO2007/128962 and WO2011/098815 (so-called "bead cleaning" technologies) were not however specifically adapted or optimised for the treatment of animal skin substrates.

The present disclosure therefore seeks to provide an apparatus and method for use in the treatment of animal skin substrates that can ameliorate or overcome the above-noted problems associated with the prior art. Particularly, there is desired a method and apparatus for treating an animal skin substrate which requires less water than the processes of the prior art and that reduces the volume of polluting and hazardous effluent produced. Furthermore, there is desired a method and apparatus for treating an animal skin substrate with a solid particulate material that provides an effective means of separating the solid particulate material from the substrate.

BRIEF SUMMARY OF THE DISCLOSURE

According to a first aspect of the present invention there is provided an apparatus for treating one or more animal skin substrates with a multiplicity of solid particles and treatment liquor comprising:

- a rotatably mounted drum comprising an internal volume having a first portion defining a treatment volume for retaining said animal substrates and a second portion defining a collecting volume, wherein the side-walls of said drum are not perforate;
- one or more inlets for introducing solid particles and treatment liquor into said treatment volume;
- a partition separating said treatment volume from said collecting volume wherein said partition allows free passage of solid particles from the treatment volume to the collecting volume and prevents the passage of the substrate(s) therethrough;
- a circulation path for conveying said solid particles from the collecting volume to the treatment volume; and
- a pumping device arranged to pump solid particles and said treatment liquor along a portion of said circulation path.

Advantageously, the present invention employs a multiplicity of solid particles (also referred to herein as a solid particulate material) to confer a more uniform and enhanced or effective mechanical action on the animal skin substrate when the drum is rotated. This can reduce the duration of the necessary treatment cycle providing improvements in efficiency over processes of the prior art. By virtue of the inclusion of the solid particles, the invention facilitates the use of only limited amounts of treatment liquor (which typically comprises water) thereby offering significant environmental benefits compared to standard processes commonly employed in this field. As the quantity of treatment liquor needed by the invention is significantly reduced, the amount of chemicals relative to a given quantity of substrate in order to provide an effective treatment of the animal skin substrates is decreased. Furthermore, the partition of the invention provides an efficient means of separating solid particles from the animal skin substrates. Effective separation of solid particles from the substrates improves the efficiency and/or efficacy of the treatment and increases the number of available particles for use in an ongoing treatment cycle or for subsequent treatment cycles. In some advantageous embodiments, the invention is able to achieve separation of solid particles from the animal skin substrates with a separation efficiency of greater than 99%.

As described herein, "treatment liquor" comprises a liquid medium used in the apparatus or treatment process of the invention. Preferably said treatment liquor can comprise water or water when combined with at least one treatment agent and/or any further additives as detailed further hereinbelow.

Preferably, said rotatably mounted drum comprises a multiplicity of solid particles therein.

Preferably, said circulation path is external to said drum.

Preferably, the or each animal skin substrate is a hide or a pelt. The treatment process using the apparatus of the invention can be a process in the production of leather. The hide or pelt can be subjected to one or more additional process steps in the production of leather before or after the treatment process using the apparatus of the invention. The hide or pelt can be a processed or unprocessed animal skin substrate.

Preferably, the axis of rotation of the drum passes through both the treatment volume and the collecting volume and no part of said axis of rotation is contained within both the treatment volume and the collecting volume.

Preferably, the circulation path provides a flow of solid particles from the collecting volume to the treatment volume and then to the collecting volume. Thus the solid particles can move through the treatment volume to the collecting volume via the partition.

Preferably, the circulation path provides a flow of treatment liquor from the collecting volume to the treatment volume and then to the collecting volume. Thus the treatment liquor can move through the treatment volume to the collecting volume via the partition.

Preferably, said apparatus comprises a processing system in said circulation path wherein said processing system receives said treatment liquor and said solid particles from the collecting volume of said drum.

Preferably, said processing system comprises a separator configured to separate at least a portion of said treatment liquor from said solid particles.

Thus, advantageously, the separation of treatment liquor from the solid particles promotes their effective re-use.

Preferably, said apparatus comprises a storage vessel for retaining said solid particles and a dispenser to introduce said solid particles to said treatment volume. The storage vessel can receive solid particles from said circulation path such as from the processing system.

Preferably, a first portion of the circulation path comprises a conduit having an inlet disposed proximate the lowermost part of the collecting volume, the conduit extending from said collecting volume. Preferably the conduit extends from said collecting volume externally of the drum. The conduit can extend to the processing system.

Preferably, a first such conduit can be provided for conveying solid particles. In some preferred embodiments a second such conduit can be provided for conveying treatment liquor. In other arrangements one or more such conduits can convey both treatment liquor and solid particles.

Preferably, the drum has an upper portion comprising at least one inlet to introduce said solid particles into said treatment volume and at least one inlet for receiving treatment liquor into said treatment volume.

Preferably, said dispenser communicates with said at least one inlet of said upper portion to introduce said solid particles into said treatment volume.

Preferably, said apparatus comprises a conduit extending from an outlet of the processing system wherein said conduit is connected to an inlet of the upper portion of the drum. The conduit can convey solid particles to the treatment volume of the drum. The conduit can convey treatment liquor to the treatment volume of the drum. The conduit can convey both treatment liquor and solid particles to the treatment volume of the drum.

Preferably, said processing system comprises a device for removing residual treatment liquor and deposits from said solid particles. Particularly, said deposits can be derived from said animal skin substrates. The processing system can further comprise a device that can carry out one or more washing or rinsing stages. In this way residual treatment liquor and deposits can be removed from the solid particles before they are conveyed to the storage vessel or re-introduced to the treatment volume of the drum.

Preferably, said processing system comprises one or more outlets for discharging treatment liquor and/or unwanted matter produced during the treatment process.

Preferably, said drum comprises a closure moveable between an open position and a closed position wherein when said closure is moved to said open position free passage of solid particles and fluids into the collecting volume from the treatment volume is permitted and wherein when said closure is moved to said closed position solid particles are prevented from passing into the collecting volume from the treatment volume whilst the passage of fluids into the collecting volume from the treatment volume is permitted. Thus, when said closure is moved to a closed position, solid particles are prevented from entering the collecting volume but fluids such as treatment liquor can still enter the collecting volume and proceed along the circulation path.

Advantageously, the use of such a closure can limit the quantity of solid particles accumulating in the collecting volume thereby reducing the possibility of blocking the circulation path and/or damaging the pumping device.

Alternatively, said drum may preferably comprise a closure moveable between an open position and a closed position wherein when said closure is moved to said open position free passage of solid particles and fluids into the collecting volume from the treatment volume is permitted and wherein when said closure is moved to said closed position any solid particles and fluids are retained in the treatment volume. Preferably when the closure is moved to a closed position, solid particles and treatment liquor are thus prevented from entering the collecting volume and proceeding along the circulation path.

Advantageously, the drum can thus include a closure to further facilitate the use of lower levels of treatment liquor in the apparatus.

Preferably, said drum is configured to rotate about a horizontal axis or an axis which is inclined to the horizontal.

Preferably, said drum is configured to rotate about an axis which is inclined to the horizontal. Rotation of the drum about such an inclined axis during the treatment process can promote separation of the solid particles from the animal substrates. The conduit of the first portion of the circulation path includes a portion which extends from the interior to the exterior of the drum and the axis of which is coincident with the axis of rotation of said drum.

In embodiments wherein said drum is configured to rotate about an axis which is inclined to the horizontal it is preferred that a major portion of the treatment volume extends above the collecting volume.

Said drum may be inclined at an angle of from about 1° to about 45°, more preferably 1° to about 30° and most preferably from about 5° to about 25° with respect to the horizontal. The inventors consider that an incline that is too steep causes the animal skin substrate(s) to slump against one side of the drum whereas a drum configured to rotate about an axis with no or minimal inclination provides reduced efficiency in terms of particle separation.

Preferably, said pumping device is arranged in the circulation path external to the drum. Preferably, said pumping device can be located downstream, particularly immediately downstream, of said collecting volume.

As noted above, the apparatus of the invention includes a partition which separates the treatment volume from the collecting volume. There exists no gap between the partition and a wall of the drum through which the animal skin substrates can pass from the treatment volume to the collecting volume.

Preferably, said partition comprises a plurality of apertures. The plurality of apertures are sized to allow passage of said solid particles therethrough and prevent the passage of said animal skin substrates therethrough.

Preferably, said partition is in the form of a perforate or reticulate screen.

Preferably, said apertures have a maximum dimension of from about 2 to 125 mm, from about 2 to 100 mm, from about 2 to 75 mm, from about 2 to 50 mm, from about 2 to about 35 mm, from about 2 to 26 mm, from about 2 to 25 mm, from about 2 to about 10 mm or from about 6 to about 10 mm. In some embodiments said apertures have a maximum dimension of about 10 mm or about 5 mm or about 2 mm. In some embodiments said apertures have a maximum dimension of from about 26 mm to about 125 mm.

The partition is configured to support the weight of said animal skin substrates. In one typical arrangement the treatment volume contains animal substrates with a combined weight of up to 50,000 kg. The treatment volume may contain animal substrates with a combined weight of from about 50 to about 50,000 kg, from about 500 to about 30,000 kg, from about 1000 kg to about 25,000 kg, from about 2000 to about 20,000 kg, from about 2500 to about 10,000 kg.

Preferably, said partition comprises metal, metal alloy, plastic, fibreglass, composite or polymeric materials. Typically, the partition is corrosion resistant. Particularly, said partition is resistant to any chemicals or additives with corrosive properties that may be present in the treatment liquor. Preferably, said partition comprises steel, especially stainless steel.

Preferably, the partition is arranged to be substantially perpendicular to the axis of rotation of said drum.

Preferably, the multiplicity of solid particles can be re-used one or more times for treatment of the animal skin substrates in, with or by the apparatus of the invention. The circulation path facilitates re-use of the solid particles as does the storage vessel. Preferably, the solid particles can be re-used at least two, three, four, five or more times, such as 10, 20, 50 or 100 or more times, for treatment of the animal skin substrates in, with or by the apparatus of the invention. The solid particles are typically not re-used more than 10,000 or more than 1,000 times.

Preferably, said solid particles have an average particle diameter of from 1 mm to 100 mm. In some embodiments the solid particles have an average particle diameter of from 1 to 50 mm or 1 to 25 mm or 1 to 15 mm or 1 to 10 mm or 2 to 8 mm or 4 to 8 mm or 5 to 7 mm.

Preferably, said solid particles have a length of from 1 mm to 100 mm. The solid particles may have a length of from 1 to 50 mm or 1 to 25 mm, or from 1 to 15 mm or from 1 to 10 mm, or from 2.0 to 8.0 mm, or from 4.0 to 7.0 mm, or from 5.0 to 7.0 mm, or from 1.0 to 5.0 mm or from 2.5 to 4.5 mm.

The skilled person will however understand that the diameter and length of the solid particles are to be selected in accordance with the maximum dimension of the apertures in the partition to ensure that the solid particles can pass freely through the screen.

Preferably, the solid particles are spheroidal, spherical or ellipsoidal.

Preferably, the solid particles can comprise a multiplicity of polymeric particles, a multiplicity of non-polymeric particles or a mixture of a multiplicity of polymeric and non-polymeric particles.

Preferably, the polymeric or non-polymeric particles can comprise or be in the form of beads.

Preferably, the polymeric particles have an average density of about 0.5 g/cm$^3$ to about 3.5 g/cm$^3$ and preferably about 0.5 to 2.5 g/cm$^3$. In other embodiments the polymeric particles have an average density of 0.5 to less than 1 g/cm$^3$.

Preferably, the polymer in the polymeric particles can comprise polyalkenes, polyamides, polyesters, polysiloxanes, polyurethanes or copolymers thereof.

Tthe polymer in the polymeric particles can comprise polyalkenes or polyurethanes, or copolymers thereof.

The polymer in the polymeric particles can comprise polyamide or polyester or copolymers thereof.

Said polyamide can comprise nylon. The polyamide can comprise Nylon 6 or Nylon 6,6.

The polyester can comprise polyethylene terephthalate or polybutylene terephthalate.

Preferably, the non-polymeric particles can comprise ceramic material, refractory material, igneous, sedimentary or metamorphic minerals, composites, metal, glass or wood.

Preferably, the non-polymeric particles have an average density of 0.5 to 20 g/cm$^3$, more preferably from 2 to 20 g/cm$^3$, especially from 4 to 15 g/cm$^3$ and most especially from 4 to 10 g/cm$^3$.

Preferably, said drum has a capacity of from 500 to 200,000 liters.

Preferably, said treatment volume comprises at least 0.5%, at least 1%, at least 5%, at least 10%, at least 20%, at least 30%, at least 40% or at least 50% of said internal volume of said drum. Preferably, said treatment volume comprises at least 60%, preferably at least 70%, more preferably at least 80% and most preferably at least 90% of the internal volume of said drum. Preferably, said treatment volume comprises not more than 99.5% of the internal volume of said drum.

Preferably, said treatment volume comprises from about 0.5% to about 99.5%, from about 1% to about 99%, from about 5% to about 95%, from about 10% to about 90%, from about 20% to about 80%, from about 30% to about 70%, from about 40% to about 60% of the internal volume of said drum. Alternatively, it is preferred that said treatment volume comprises from about 0.1% to about 10% of the internal volume of said drum.

Preferably, said collecting volume comprises not more than 30% of said internal volume of said drum. Preferably, said collecting volume comprises not more than 25%, preferably not more than 20%, more preferably not more than 15%, yet more preferably not more than 10% and most preferably not more than 5% of the internal volume of said drum. Preferably, said collecting volume comprises at least 0.5% of the internal volume of said drum.

Preferably, said collecting volume comprises from about 0.5% to about 99.5%, from about 1% to about 99%, from about 5% to about 95%, from about 10% to about 90%, from about 20% to about 80%, from about 30% to about 70%, from about 40% to about 60% of the internal volume of said drum. Preferably, said collecting volume comprises from about 0.5% to about 10% of the internal volume of said drum.

According to a second aspect of the present invention there is provided a method of separating a multiplicity of solid particles from one or more animal skin substrates during a treatment process comprising:

agitating said animal skin substrates with a multiplicity of solid particles and treatment liquor in a treatment volume of a rotatably mounted drum wherein the side-walls of said drum are not perforate, said drum having a collecting volume separated from the treatment volume by a partition, wherein said method further comprises allowing the solid particles and treatment liquor to pass through the partition from the treatment volume to the collecting volume whilst retaining said animal skin substrates in the treatment volume.

Advantageously, the method of the second aspect of the invention provides an effective means of separating solid particles within the drum thereby enhancing the efficiency of the treatment as additional steps to disengage residual solid particles from the substrate are greatly simplified or are no longer needed.

The rotatably mounted drum of the second aspect of the invention can comprise any of the features or any permitted combination of features stated above with respect to the rotatably mounted drum of said first aspect of the invention.

Preferably, the axis of rotation of the drum is configured to pass through both the treatment volume and the collecting volume and no part of said axis of rotation is contained within both the treatment volume and the collecting volume.

Preferably, said method comprises circulating said treatment liquor from said collecting volume to said treatment volume to provide a flow of treatment liquor through the treatment volume and continuing agitation of said animal skin substrates in said drum for a predetermined period or until a desired separation of solid particles from said animal skin substrates is achieved.

Preferably, said method further comprises conveying said solid particles and said treatment liquor from the collecting volume, separating at least a portion of said treatment liquor from said solid particles and re-introducing said solid particles into said treatment volume. The method can preferably further comprise agitating said animal skin substrates with said solid particles and treatment liquor in the treatment volume in a subsequent agitation step.

Preferably, said method comprises the steps of:

i) introducing treatment liquor into said treatment volume and agitating said animal skin substrates with said solid particles and said treatment liquor in the treatment volume for a first agitation step;

ii) allowing said treatment liquor to pass through the partition to the collecting volume and conveying said treatment liquor from the collecting volume along a circulation path;

iii) re-introducing said treatment liquor from said circulation path into said treatment volume.

The above-noted steps i) ii) and iii) of the method may be performed separately, simultaneously or they may overlap in time (synchronously/contemporaneously).

Preferably, said circulation path is external to said drum.

Thus, advantageously, the method of the invention permits re-use of the treatment liquor in more than one phase or for multiple agitation steps with the animal substrates within a given treatment cycle.

Preferably, said method further comprises separating at least a portion of said treatment liquor received from the collecting volume from said solid particles before re-introducing said treatment liquor from said circulation path into said treatment volume.

Preferably, said method comprises extracting effluent and/or unwanted matter from the treatment liquor received from the collecting volume before re-introducing said treatment liquor into said treatment volume.

Preferably, said method comprises the steps of:

i) introducing said solid particles into said treatment volume and agitating said animal skin substrates with said solid particles and said treatment liquor in the treatment volume for a first agitation step;

ii) allowing said solid particles to pass through the partition to the collecting volume and conveying said solid particles from the collecting volume along a circulation path external to the drum;

iii) re-introducing said solid particles into said treatment volume from said circulation path and agitating said animal skin substrates with said solid particles and treatment liquor in the treatment volume for a subsequent agitation step.

The above-noted steps i) ii) and iii) of the method may be performed separately, simultaneously or they may overlap in time (synchronously/contemporaneously).

Preferably, said circulation path is external to said drum.

Thus, advantageously, the method of the invention permits re-use of the solid particles in more than one phase or for multiple agitation steps with the animal skin substrates within a typical treatment cycle.

Preferably, said method further comprises separating at least a portion of said treatment liquor from said solid particles before re-introducing said solid particles from said circulation path into said treatment volume for a subsequent agitation step.

Preferably, said method further comprises subjecting said solid particles to a cleaning operation using a cleaning formulation before re-introducing said solid particles into said treatment volume for a subsequent agitation step.

Preferably, said method comprises conveying said solid particles from the collecting volume to a processing system and performing said cleaning operation in said processing system.

Preferably, said method comprises draining said treatment liquor from the drum and subjecting said solid particles to said cleaning operation within said drum before re-introducing said solid particles into said treatment volume for a subsequent agitation step.

Thus, advantageously, subjecting the solid particles to a cleaning operation can extend their usable lifetime for use multiple agitation steps.

Preferably, said drum comprises a closure moveable between an open position and a closed position wherein when said closure is moved to said open position free passage of solid particles and fluids into the collecting volume from the treatment volume is permitted and wherein when said closure is moved to said closed position solid particles are prevented from passing into the collecting volume from the treatment volume whilst the passage of fluids into the collecting volume from the treatment volume is permitted, wherein said method comprises moving said closure from said open position to said closed position or moving said closure from said closed position to said open position at one or more points during the treatment process.

Alternatively, said drum can preferably can comprise a closure moveable between an open position and a closed position wherein when said closure is moved to said open position free passage of solid particles and fluids into the collecting volume from the treatment volume is permitted and wherein when said closure is moved to said closed position any solid particles and fluids in the treatment volume are retained in the treatment volume, wherein said method comprises agitating said animal skin substrate(s) and said solid particles in said drum for a predetermined period with said closure in said closed position and moving said closure to an open position when said predetermined period has elapsed.

Preferably, said method further comprises introducing treatment liquor into said drum when said predetermined period has elapsed.

Preferably, said drum is caused to rotate about an axis which is inclined to the horizontal for at least a portion of said treatment process. Preferably said drum is caused to rotate about an axis which is inclined to the horizontal for the duration of said treatment process.

Preferably, said drum is caused to rotate at a speed of from about 1 to about 50 rpm, preferably from about 1 to about 30 rpm, and preferably from about 1 to about 15 rpm.

Particularly wherein the treatment process is a beamhouse or a tanning or a retanning or a fatliquoring or a dyeing process, the drum may be caused to rotate at a speed of from about 3 to about 14 rpm. Where the treatment process is a beamhouse or a tanning process or a retanning or a fatliquoring or a dyeing process, the drum may be caused to rotate at a speed of from about 5 and 13 rpm. Where the treatment process is a beamhouse or a tanning or a retanning or a fatliquoring or a dyeing process, the drum may be caused to rotate at a speed of from about 8 and 12 rpm.

Particularly wherein the treatment process is a beamhouse process, the drum may be caused to rotate at a speed of from about 9 to about 14 rpm.

Particularly wherein the treatment process is a beamhouse or a tanning or a retanning or a fatliquoring or a dyeing process, the drum may be caused to rotate at a speed of not more than 15 rpm or not more than 13 rpm, or not more than 12 rpm, or not more than 10 rpm, or not more than 8 rpm, or not more than 6 rpm, or not more than 5 rpm, not more than 4 rpm, not more than 3 rpm or not more than 1 rpm.

Preferably, said treatment volume has an ullage volume of at least 10% by volume. Preferably said treatment volume has an ullage volume of at least 20% by volume, and most preferably from 30 to 70% or from 30 to 60% by volume. These ullage volumes can be effective in order to provide for efficient mixing whilst maximising the utilisation capacity of the apparatus.

Preferably, the or each animal skin substrate is a hide or pelt.

Preferably, said treatment process is a tannery process.

Preferably, said tannery process is selected from one or more of cleaning, curing, beamhouse treatments, tanning, re-tanning, fat liquoring, enzyme treatment, dyeing and dye fixing.

Typical beamhouse treatments include soaking, liming, deliming, reliming, unhairing, fleshing, bating, degreasing, scudding, bating, pickling and depickling.

Preferably, said treatment process is a process used in the production of leather.

Preferably, said process used in the production of leather includes one or more of:

curing, beamhouse treatments, fat liquoring, pretanning, tanning, retanning, tawing, crusting and dyeing.

Preferably, the treatment liquor is aqueous. The treatment liquor can comprise at least 0.1% w/w water, or at least 1% w/w water, or at least 5% w/w water, or between 5% and 99.9% w/w water. In further embodiments the treatment liquor comprises not more than 99.9% w/w water. Minor amounts of organic solvents (preferably less than 10% w/w, more preferably less than 5% w/w) can be present in the treatment liquor however they are preferably absent.

Alternatively, the treatment liquor is substantially free from water except for that originating from the or each animal substrate. Thus the treatment liquor can be substantially free from water except from that derived from any latent fluid present within the animal skin substrate(s) itself. Thus, water can be carried into the drum originating from the animal skin substrate. In further embodiments the treatment liquor is substantially free from water.

Preferably, said treatment liquor comprises at least one treatment agent selected from tanning agents, re-tanning agents and tannery process agents.

Preferably, said treatment liquor comprises at least one colourant.

Preferably, said colourant is selected from one or more dyes, pigments, optical brighteners or mixtures thereof.

Preferably, said solid particles are re-used one or more times in the same treatment method or for the treatment of further animal skin substrates in subsequent treatments in accordance with the method of the second aspect of the invention. Such re-use or re-uses can preferably be in an apparatus according to the first aspect of the invention. Thus, preferably, the solid particles are used in a plurality of agitation steps with animal skin substrates in accordance with the method as described herein.

Preferably, the method further comprises extracting the animal skin substrate from the drum and subjecting the substrate to a secondary solid particulate material removal process for the separation of residual solid particulate material from the animal skin substrate.

Preferably, the secondary solid particulate material removal process comprises passing the animal skin substrate between opposed rotating cylindrical brushes or subjecting the solid particulate material on the animal skin substrate to removal by suction with a suction device.

Preferably, said method of said second aspect of the invention is performed using the apparatus of said first aspect of the invention. The method of the second aspect of the invention can thus be carried out in an apparatus comprising any of the features or any permitted combination of features described above in relation to the first aspect of the invention.

In accordance with a third aspect of the invention there is provided a method of treating one or more animal skin substrates wherein said method comprises the method of separating a multiplicity of solid particles from one or more animal skin substrates according to the second aspect of the invention. The method of treating said one or more animal skin substrates can thus comprise treating the animal skin substrate(s) by performing any of the treatment processes described above in relation to the second aspect of the invention or any of the treatment processes described herein.

BRIEF DESCRIPTION OF THE DRAWINGS

For a better understanding of the invention and to show how the same may be carried into effect, reference will be made, by way of example only, to the following drawings, in which.

DETAILED DESCRIPTION

The apparatus and method of the invention employs a solid particulate material (also referred to herein as a multiplicity of solid particles) for use in the treatment of animal skin substrates. The use of the apparatus and method of the invention can enable the modification or transformation of the properties of the animal skin substrate prior to further treatment or processing of the substrate to form a manufactured article. The invention thus encompasses treatment steps performed on hides, pelts and the like before the substrate is prepared for consumer, domestic and/or industrial purposes (for example, in clothing (e.g. shoes and trainers), upholstery or automotive industries).

Notably, the treatment performed by the invention is distinguished from processes such as "laundering" wherein the substrate is typically a finished garment or fabric (being a manufactured article) and wherein the treatment merely relates to removing stains, soil and other unwanted matter from the surface of the substrate. Separation of solid particles from animal skin substrates is complicated by the texture and composition of the substrate which typically comprises a soft, fleshy tissue. The soft, fleshy nature of such substrates increases the likelihood that solid particles, when agitated with the substrate in a rotating drum, are more likely to adhere to the substrate surface or become embedded therein. The present invention therefore seeks to provide a treatment apparatus and method that remedies the deficiencies of the water intensive processes for treating animal skin substrates of the prior art and which also provides a practical and effective way of separating solid particles from the substrate.

Figure 1:
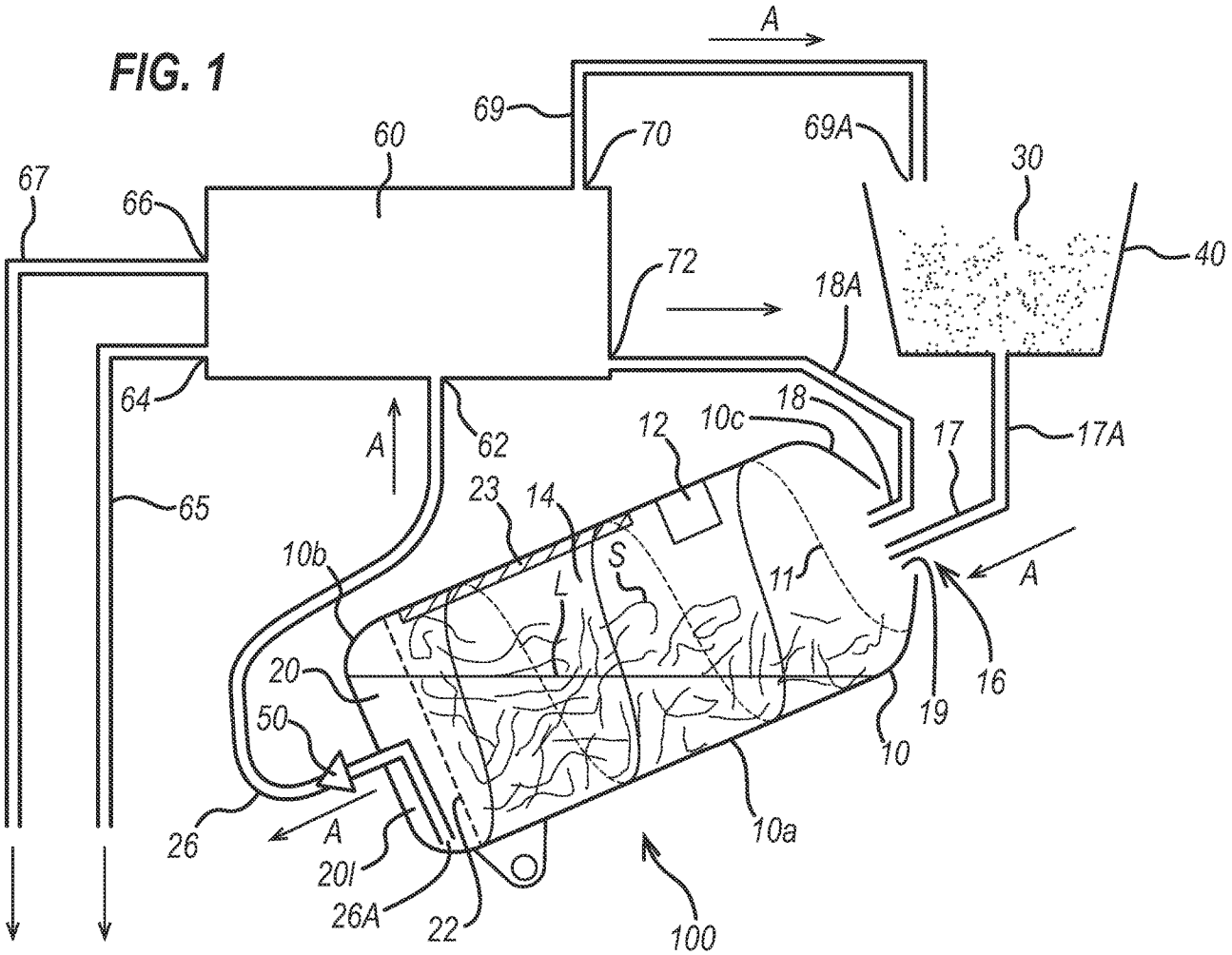
FIG. 1 is a schematic view of the apparatus according to an embodiment of the invention containing an animal skin substrate (S)

As shown in FIG. 1, the treatment process carried out by the invention is performed in an apparatus 100 comprising a drum 10. In use of the apparatus 100, the drum 10 contains the animal skin substrates (S) being treated. The drum 10 is mounted for rotation about an axis and the animal substrates are brought into contact with solid particulate material, treatment liquor including any treatment agents and/or further additives as may be desirable within the drum 10. The drum 10 may be mounted for rotation about a horizontal axis or, alternatively, an axis which is inclined to the horizontal. Preferably the drum 10 is mounted about an axis inclined to the horizontal as this advantageously promotes enhanced separation of the solid particulate material from the substrate surface as the drum rotates. In such embodiments a major portion of the treatment volume preferably extends above the collecting volume. Typically the drum is inclined at an angle of from about 1° to about 45°, more preferably 1° to about 30° and most preferably from about 5° to about 25° with respect to the horizontal. In some embodiments the drum is inclined at angle of about 14° with respect to the horizontal.

Alternatively, the drum 10 is mounted about a vertical axis or, more preferably, an axis which is inclined with respect to the vertical. This variant of the apparatus 100 can promote separation of the solid particulate material from the substrate surface as the drum rotates. In some embodiments the drum is inclined at an angle of between about 1° and about 89°, from about 89° to about 60°, from about 85° to about 65° with respect to the vertical. Preferably, the drum is inclined at angle of about 76° with respect to the vertical.

The drum 10 can be mounted such that the angle of inclination of the axis of rotation can be varied. This can enable a mechanical action on the animal skin substrate of variable strength or intensity during the course of the treatment process.

The drum 10 has an access means 12 through which the animal skin substrate to be treated can be loaded into the drum 10 and through which the treated substrate can be removed after the treatment process. The access means 12 can be in the form of a door which may be conveniently hinged or slidably mounted for movement between open and closed configurations. When the door 12 is moved to an open position, access is permitted to place one or more animal skin substrates for treatment inside the drum 10. When the door 12 is moved to a closed position, the apparatus 100 is sealed. Alternatively, the animal skin substrate can be loaded via an opening 19 disposed at one end of the drum 10.

The drum 10 is defined by a side wall 10*a* which encloses the internal volume containing the animal substrates together with portions of the solid particulate material and treatment liquor. FIG. 1 illustrates a drum 10 having a cylindrical side wall 10*a*, however non-cylindrical drums with more than one side wall are also permissible. The internal volume of the drum 10 is further defined between a lower end wall portion 10*b* and an upper end wall portion 10*c*. Unlike the apparatus disclosed in WO2011/098815 and other equivalent bead cleaning machines of the prior art, the side wall(s) of drum 10 are not perforate and are thus fluid retaining. Instead, and as will be clear from the description, treatment liquor and solid particulate material are preferably able to enter and exit the internal volume of the drum 10 from first and second end regions of the drum 10.

The internal surface of the side wall 10*a* of the drum 10 can include means to encourage further agitation of the substrates during the treatment process. The internal surface of the side wall 10*a* can include one or more generally spiral or helical fins 11 to facilitate agitation of the animal skin substrate as the drum 10 rotates. The inclusion of spiral or helical fins are particularly useful in wherein the drum 10 is mounted about an axis that is inclined with respect to the horizontal. Alternatively, the drum 10 can include one or more protrusions projecting inwardly from the internal surface of the side wall 10*a*. Said protrusions can be in the form of pegs such as wooden or plastic dowels. The protrusions can be in the form of planar shelves that run substantially parallel to the axis of rotation of the drum 10. The above-noted one or more protrusions can be particularly suitable for drums mounted about a horizontal axis.

The drum 10 can be of the size which is to be found in most tanneries for the processing of animal hides and can typically have a capacity in the region of 500 to 40,000 liters. Typical size of a drum 10 to process animal hides in this range would generally comprise a cylinder with a diameter in the region of 0.1 to 10 m, preferably from 0.5 to 5 m, and a length of between 0.1 and 10 m, preferably between 0.5 and 5 m. Larger drum sizes are however permissible and can have a capacity of up to 200,000 liters. Preferably the drum 10 has a capacity of greater than 100 liters and more preferably greater than 1000 liters. Said drum 10 may have a capacity of from 500 to 200,000 liters, preferably of from 500 to 135,000 liters, more preferably from 500 to 75,000 liters and most preferably from 500 to 40,000 liters.

The drum 10 further comprises an internal volume having a first portion defining a treatment volume 14 and a second portion defining a collecting volume 20. The treatment volume 14 defines the region of the drum 10 in which the animal substrates are contained and wherein said animal substrates are agitated with treatment liquor (plus any treatment agents and/or any further additives) and the solid particulate material. The treatment volume 14 can be defined in an upper portion of the drum 10 and the collecting volume 20 can be defined in a lower portion of the drum 10.

The treatment volume 14 can be substantially larger than the collecting volume 20. In some preferred arrangements, the treatment volume 14 comprises about 90% of the internal volume of the drum. The collecting volume 20 can comprise about 10% of the internal volume of the drum. In alternative embodiments, and particularly those adapted to use low quantities of treatment liquor, the collecting volume 20 can be larger than the treatment volume 14.

The treatment volume 14 of the drum 10 is sufficiently large so to accommodate the animal skin substrate to be treated, the solid particulate material and treatment liquor, whilst still providing sufficient ullage to allow for efficient circulation and mixing of the materials when agitated during the treatment process. Typically, allowance should be made for ullage values of at least 10% by volume, preferably at least 20% by volume, and most preferably from 30 to 70% or 30 to 60% by volume in order to provide for efficient mixing whilst maximising the utilisation capacity of the treatment process. Loading of the animal skin substrates, solid particles and treatment liquor (plus any additives) in the apparatus 100 can thus be carried out to accommodate the above-noted ullage values.

The apparatus 100 further comprises one or more inlets 16 to deliver various components used in the treatment process (i.e. the solid particulate material, treatment liquor, treatment agents and/or any further additives) to the drum 10. Preferably, said one or more inlets 16 are arranged to deliver said components into the treatment volume 14. The upper portion of the drum 10 can therefore conveniently comprise said one or more inlets 16. In some embodiments the apparatus 100 comprises a plurality of inlets to deliver the respective components used in the treatment process into the treatment volume 14.

The apparatus 100 can comprise a first drum inlet 17 to introduce solid particulate material 30 into the treatment volume 14 of said drum 10. The solid particulate material 30 may or may not also be delivered in combination with treatment liquor, treatment agents and/or any further additives from the same inlet 17.

The apparatus 100 can further comprise a second drum inlet 18 for receiving treatment liquor into the treatment volume 14 of said drum 10. The second drum inlet 18 can additionally be used to re-introduce solid particulate material into the treatment volume 14 of said drum 10.

The upper portion of the drum 10 can thus comprise said first drum inlet 17 and said second drum inlet 18. Each of said first drum inlet 17 and said second drum inlet 18 can extend through a portion of the side wall 10*a*. Alternatively, the drum 10 can include an opening 19 through which the one or more drum inlets project.

Within a lower portion of the drum 10 is the collecting volume 20. The collecting volume 20 contains treatment liquor and solid particulate material that have previously passed through treatment volume 14 following agitation with the substrate. The collecting volume 20 can additionally comprise one or more inlets for the introduction of additional treatment agents used in treatment process. In particular, the collecting volume 20 can comprise one or more inlets to introduce gaseous treatment agents that can be used in the treatment process.

A partition or screen 22 separates the collecting volume 20 from the treatment volume 14. The partition 22 thus divides the internal volume of the drum 10 into two portions respectively located at a first end and a second end. The partition 22 comprises a first side which faces the treatment volume 14 and an opposed second side which faces the collecting volume. The partition 22 can be in the form of a perforate or reticulate screen. Preferably, the partition 22 is in the form of a mesh. The mesh may be extruded, orientated, expanded, welded, etched, woven, knitted, or electroformed. Preferably the partition 22 is generally planar. Furthermore, the partition is typically arranged to be substantially perpendicular to the axis of rotation of the drum 10.

The partition 22 comprises a material that is sufficiently strong to withstand or support the combined weight of animal skin substrates loaded into the treatment volume 14 of the drum 10. The treatment volume 14 can contain animal skin substrates with a combined weight of anywhere between 50 kg and 50,000 kg. In addition, the partition 22 preferably comprises materials that exhibit some resistance to corrosion and particularly comprises materials that exhibit resistance to the corroding effects of any chemicals or additives present in the treatment liquor. Thus, the partition 22 can comprise corrosion resistant metals, corrosion resistant metal alloys, plastics, fibrous, fibreglass, composites or polymeric materials. Other flexible/ductile materials can also be used. Furthermore, the partition 22 may be coated or uncoated.

The partition 22 may thus comprise metals and metal alloys including, but not limited to, steel, aluminium, brass, copper, titanium and tungsten. In preferred embodiments the partition 22 comprises stainless steel.

The partition 22 may thus comprise composites including, but not limited to, carbon, boron or glass fibre filled polyester or polycarbonate.

The partition 22 may thus comprise plastic materials including, but not limited to, polypropylene, polyethylene, polycarbonate, nylon, polyvinylchloride, high-density polyethylene or polytetrafluoroethylene.

The partition 22 can comprise various combinations of the above-noted materials. For example, the partition 22 can comprise plastic materials reinforced with a suitable metal or metal alloy.

Where the partition 22 is in the form of a mesh, suitable meshes include, but are not limited to, aramid, polycarbonate, polyester or polyacrylic polymer meshes.

As noted above, the partition 22 thus comprises a plurality of holes or apertures. The apertures are dimensioned such that treatment liquor and the solid particulate material can flow freely through the partition 22. However, the size of the apertures is such that the animal skin substrates cannot pass through the partition 22. The partition 22 is therefore arranged so that the animal skin substrates residing in the treatment volume 14 are prevented from entering the collecting volume 20. The skilled person will however understand that, depending on the size of the holes in the partition 22, orientations of the animal skin substrate during rotation of the drum 10 may be possible whereby a minor part such as an edge or periphery of a substrate temporarily projects into a portion of the space defined by the collecting volume 20. However, the temporary transgression of a minor part of a given animal skin substrate beyond the partition 22 into the collecting volume 20 has no adverse impact on the performance of the apparatus 100 and the scope of the term "prevented from entering the collecting volume 20" is thus intended to encompass such a transitory occurrence.

The partition 22 can comprise apertures wherein said apertures have a maximum dimension of about 125 mm, 100 mm, 75 mm, 50 mm, 35 mm, 26 mm, 25 mm, 10 mm, 5 mm or about 2 mm. Said apertures can have a maximum dimension of from about 2 to 100 mm, from about 2 to 75 mm, from about 2 to 50 mm, from about 2 to about 35 mm, from about 2 to 26 mm, from about 2 to 25 mm or from about 2 to about 10 mm. The partition 22 can comprise apertures having a maximum dimension of from about 2 to about 10 mm, in particular about 4 to about 10 mm, or said apertures can have a maximum dimension of from about 5 to about 8 mm, or said apertures can have a maximum dimension from about 6 to about 10 mm or the partition 22 can comprise apertures having a maximum dimension of from about 26 mm to about 125 mm.

Preferably, the solid particles employed in the invention have an average particle diameter of from 1 mm to 100 mm. The solid particles can have an average particle diameter of from 1 to 50 mm or 1 to 25 mm or 1 to 15 mm or 1 to 10 mm or from 2.0 to 8.0 mm, or the solid particles can have a diameter of from 4.0 to 7.0 mm or from 5.0 to 7.0 mm, or the solid particles can have an average particle diameter of from or 1.0 to 6.0 mm, or from 1.0 to 5.0 mm or from 2.5 to 4.5 mm. The effective average diameter can also be calculated from the average volume of a particle by simply assuming the particle is a sphere. The average is preferably a number average. The average is preferably performed on at least 10, more preferably at least 100 particles and especially at least 1000 particles.

The solid particles can have a length of from 1 mm to 100 mm, or from 1 to 50 mm or 1 to 25 mm, or from 1 to 15 mm or from 1 to 10 mm, or from 2.0 to 8.0 mm, or from 4.0 to 7.0 mm, or from 5.0 to 7.0 mm. In other embodiments the solid particles can have a length of from 1.0 to 6.0 mm, or from 1.0 to 5.0 mm or from 2.5 to 4.5 mm. The length can be defined as the maximum 2 dimensional length of each 3 dimensional solid particle. The average is preferably a number average. The average is preferably performed on at least 10, more preferably at least 100 particles and especially at least 1000 particles.

The apparatus 100 further comprises a storage vessel 40 to retain the solid particulate material 30 before delivery to the drum 10. The storage vessel 40 can be in the form of a hopper. The apparatus 100 additionally includes a dispenser comprising a delivery tube 17A connected to the storage vessel 40 to allow transport of solid particulate material 30 to the first drum inlet 17 for introduction to the treatment volume 14. Furthermore, storage vessel 40 can include one or more valves or gates to control the entry of solid particulate material 30 to delivery tube 17A thereby regulating the flow of solid particulate material 30 to the drum 10. The storage vessel 40 can further comprise one or more inlets or outlets which communicate with blowing and/or sucking devices to facilitate the flow of solid particulate material to the delivery tube 17A.

The one or more valves or gates of the storage vessel 40 can further be used to segregate the solid particulate material. Segregated solid particulate material can then be cleaned, washed and rinsed in the storage vessel 40. Preferably, said storage vessel 40 additionally comprises one or more inlets for the introduction of cleaning agents to clean the solid particulate material. Furthermore, said storage vessel 40 can comprise one or more inlets to introduce gases cleaning agents for cleaning the solid particulate material.

Storage vessel 40 may be arranged above the inlet 17 of the drum 10 enabling the solid particulate material 30 to pass along delivery tube 17A under the influence of gravity into the drum 10. Other configurations are however possible whereby the storage vessel 40 is located at a position below the inlet 17 and additional pumping means are provided to transport solid particulate material 30 from the storage vessel 40 into the drum 10.

The treatment apparatus 100 further comprises a conduit 26 for conveying treatment liquor and/or the solid particulate material out of the drum 10 from the collecting volume 20. In addition, the collecting volume 20 may also contain small quantities of matter displaced from the animal skin substrate following agitation of the substrate in the treatment volume 14. Matter displaced from the animal skin substrate will of course only enter the collecting volume 20 if it is small enough to pass through the holes in the partition 22. The conduit 26 has an inlet disposed proximate the lowermost part of the collecting volume and forms a first portion of a circulation path (external to the drum) for conveying solid particles and/or treatment liquor from the collecting volume 20 to the treatment volume 14. A portion of the conduit 26 extends from the interior to the exterior of the drum 10 and has an axis which is coincident with the axis of rotation of the drum 10. The conduit 26 can extend into the collecting volume 20 and has an inlet 26A which opens into a lower region 201 of the collecting volume 20 below the treatment liquor level (L) and proximate a lowermost region of the side wall 10*a*. In some embodiments more than one of such conduits 26 can be provided for independently conveying solid particulate material, treatment liquor or for conveying solid particulate material and treatment liquor.

As noted above, the apparatus 100 includes a circulation path external to the drum for conveying said solid particles from the collecting volume to the treatment volume. The apparatus 100 additionally comprises a pumping device 50 to pump treatment liquor and/or the solid particulate material from the collecting volume 20 along a portion of the circulation path. Preferably, the pumping device 50 is arranged in the circulation path. Furthermore, the pumping device 50 can be located downstream, preferably immediately downstream, of the collecting volume 20. The pumping device 50 can be located at or proximate the lower end wall portion 10*b* of the drum 10. Or the pumping device 50 can be located within the collecting volume 20 of the drum 10.

Solid particulate material and/or treatment liquor can be conveyed from the collecting volume 20 via conduit 26 to be received by a processing system 60. The processing system 60 can comprise one or more compartments or units adapted to perform various operations on the treatment liquor and/or solid particulate material received from the drum 10. Solid particulate material and treatment liquor can pass into the processing system 60 through an entry port 62.

The processing system 60 is configured to separate the solid particulate material from the treatment liquor received from the collecting volume 20. The processing system 60 may therefore comprise a separator including one or more filters or valves effective to separate treatment liquor or at least a portion of the treatment liquor from the solid particulate material. Furthermore, the processing system can comprise a device for removing residual treatment liquor and deposits generated as a result of the treatment process from said solid particles. The deposits can include any matter derived from the animal skin substrates. In particular the processing system 60 can include one or more blowing and/or sucking devices to enable removal of residual treatment liquor and/or deposits from the solid particles. Furthermore, the processing system 60 can include a device to carry out one or more washing or rinsing stages. The processing system 60 can additionally comprise one or more inlets for the introduction of cleaning agents to enable cleaning of the solid particulate material. Following the separation of treatment liquor from the solid particulate material and/or following removal of residual treatment liquor and deposits, the solid particulate material can be conveyed to the storage vessel 40 from an outlet 69A of the processing system via a conduit 69. The conduit 69 comprises an end 69A located at or proximate to an opening into storage vessel 40.

In addition, the processing system 60 can be configured to extract any waste materials and effluent generated as a result of the treatment process. Waste material can thus include any unwanted solids such as soil and particulate deposits displaced from the surface of the animal substrate. The processing system 60 can thus comprise one or more outlets for discharging treatment liquor and/or unwanted matter produced during the treatment process. Treatment liquor pumped from the collecting volume 20, which may further include said soil and particulate deposits entrained therein, can be subject to one or more filtering operations. The processing system 60 can thus include one or more fine filters for removing soil, particulate deposits along with any residual treatment agents. The filtering operation can be conducted after the solid particles have been separated from the treatment liquor. Following the filtering step, unwanted solids can be removed from the processing system through a first outlet port 64 and first drain 65. The processing system 60 can additionally comprise a second outlet port 66 and second drain 67 to remove liquid effluent produced from the treatment process.

The processing system 60 can be adapted to recycle all of the treatment liquor or a portion of the treatment liquor received from the collecting volume 20. Treatment liquor may be recycled following the above-mentioned filtering operations to remove effluent and/or unwanted solids. Recycled treatment liquor can be delivered to the treatment volume 14 of the drum 10 via a conduit 18A extending from an outlet 72 of the processing system 60. Treatment liquor enters the treatment volume 14 through second drum inlet 18. Thus in some embodiments, there is provided a circulation path for treatment liquor extending from the collecting volume 20 to the treatment volume 14 via the processing system 60. Alternatively, or in addition, fresh treatment liquor can be delivered from the processing system 60 to the treatment volume 14 of the drum 10 via conduit 18A. The recycled and/or fresh treatment liquor can comprise water or water in combination with one or more treatment agents. The apparatus 100 can comprise a plurality of outlets from the processing system 60 and conduits each connected to a respective inlet that is in communication with the treatment volume 14 of the drum 10. Such an arrangement can enable both recycled and fresh treatment liquor to separately be introduced to the treatment volume 14 of the drum 10. The processing system 60 can comprise a liquid storage tank that can retain both fresh and recycled treatment liquor for use in the treatment process. In such embodiments, the processing system 60 can comprise one or more additional outlets to deliver treatment liquor received from the collecting volume 20 to the liquid storage tank.

The apparatus 100 further provides a circulation path for the solid particulate material that extends from the collecting volume 20 to the processing system 60. Furthermore, the circulation path for the solid particulate material can extend from the processing system 60 to the storage vessel 40. In some embodiments, solid particulate material can be circulated and re-used in a single treatment process carried out by the apparatus 100. Solid particulate material when circulated by the apparatus 100 can proceed along the path indicated by the arrows labeled "A" as illustrated in FIG. 1. The apparatus 100 can further include one or more blowing and/or sucking devices to facilitate conveyance of the solid particles along the circulation path(s).

Alternatively, the apparatus 100 can provide a different circulation path for the solid particulate material. In such embodiments, solid particulate material can proceed from the collecting volume 20 to the processing system 60 via conduit 26 and then return to the treatment volume 14 via the conduit designated 18A and drum inlet 18. In such embodiments, conduit 18A extending from the outlet 72 of the processing system 60 conveys solid particles to the treatment volume 14 of the drum via drum inlet 18. In these embodiments, a further inlet can be provided exclusively for the introduction of treatment liquor. Alternatively, conduit 18A extending from the outlet 72 of the processing system 60 can convey both solid particles and treatment liquor to the treatment volume 14 of the drum via drum inlet 18. In these embodiments, drum inlet 18 can convey solid particles and/or treatment liquor for re-use in the treatment process performed in the drum 10 whereas drum inlet 17 can provide the first introduction of solid particles and/or treatment liquor into the drum 10.

The drum 10 can additionally comprise a closure 23. The closure 23 is moveable between a closed position and an open position. In the closed position the closure 23 retains fluids (i.e. the treatment liquor), animal skin substrate(s) and solid particles in the treatment volume 14. Thus when the closure 23 is moved to a closed position, solid particles and treatment liquor are prevented from entering the collection volume 20 and proceeding along the above-noted circulation path. When the closure is move to an open position, solid particles and treatment liquor can again pass freely through the partition 22 and proceed through the collection volume 20 and enter the circulation path. The apparatus 100 may comprise an electronic controller configured to move the closure 23 between open and closed positions. The closure 23 can be located such that when it is moved to the closed position it is brought directly in front of or in contact with the first side of the partition 22. Alternatively, the closure 23 can be located such that when it is moved to the closed position it is brought directly behind or in contact with the opposed second side of the partition 22. The closure 23 can be in the form of a hingedly mounted or slidably mounted door or flap. The closure 23 can comprise a diaphragm.

Advantageously, the provision of the closure 23 further enables the treatment process to be carried out using only low levels of fluid. Thus, prior to conducting a treatment cycle or a phase in the treatment cycle using the apparatus 100 of the invention, the closure 23 can be moved to a closed position. The animal skin substrates can be agitated in the treatment volume with solid particles together with any fluids or treatment liquor present in the drum with the closure 23 retained in the closed position. Typically agitation will be performed for a predetermined period sufficient to complete a phase in the treatment cycle of the animal skin substrate(s). When the predetermined period has elapsed, the closure can be moved to the open position permitting free passage of solid particles and treatment liquor through the partition 22 to the collection volume 20 prior to entering the circulation path. Use of the embodiments comprising the closure 23 described above, ensures a constant circulation of treatment liquor throughout the apparatus 100 is not necessary thus facilitating effective treatment of the substrates with minimal liquor. Additional treatment liquor can be introduced to the treatment volume after agitation of animal skin substrates and solid particles with the closure 23 in a closed position. The addition of supplementary treatment liquor can facilitate the circulation of solid particles from the collection volume 20 along the above-noted circulation path(s).

Alternatively, the drum 10 can comprise a closure 23B (not shown in the figures) moveable between a closed position and an open position whereby in the closed position the closure 23B is configured to prevent solid particles from passing into the collecting volume 20 from the treatment volume 14 whilst permitting the passage of fluids into the collecting volume 20 from the treatment volume. Thus when the closure 23B is moved to a closed position, solid particles are prevented from entering the collecting volume 20 and proceeding along the above-noted circulation path yet treatment liquor can still be circulated along the circulation path. When the closure 23B is moved to an open position, solid particles and treatment liquor can again pass freely through the partition 22 and proceed through the collection volume 20 and enter the circulation path. As for the closure 23 noted above, the apparatus 100 may comprise an electronic controller configured to move the closure 23B between open and closed positions. Furthermore, closure 23B can be located such that when it is moved to the closed position it is brought directly in front of or in contact with the first side of the partition 22. Alternatively, the closure 23B can be located such that when it is moved to the closed position it is brought directly behind or in contact with the opposed second side of the partition 22. The closure 23B can comprise a plurality of apertures. The apertures of the closure 23B are smaller than the maximum dimension of the solid particles to prevent their passage therethrough when the closure 23B is moved to the closed position. Said apertures of the closure 23B can have a maximum dimension less than 1 mm. The closure 23B can be in the form of hingedly mounted or slidably mounted member with apertures formed therein. The closure 23B can be a perforate or reticulate screen or can in the form of a mesh.

Advantageously, the use of the closure 23B in the apparatus 100 can limit the quantity of solid particles accumulating in the collecting volume 20 reducing the possibility of blocking the circulation path. Furthermore, closure 23B can enable the use of lower flow rates providing energy savings and improvements in efficiency. During operation of the treatment cycle a user can conveniently switch the position of the closure 23B between open and closed positions as desired. For example, if the flow rate of solid particles through the apparatus 100 and into the collecting volume 20 is too high, the flow of solid particles can temporarily be arrested by moving the closure 23B into a closed position. In other embodiments the closure 23B can be moved from an open position to a closed position or from a closed position to an open position after a predetermined period in the treatment cycle has elapsed.

The treatment process utilizing the method of the present invention can consist of a "treatment cycle". As used herein, the term "treatment cycle" refers to the total duration necessary to complete the desired treatment of the animal skin substrate and may comprise one or more phases or stages. For example, a first portion of the treatment liquor which may comprise water can be added to the animal skin substrate before the addition of the solid particulate material. The animal skin substrate can be agitated with the treatment liquor alone in the drum of the apparatus prior to agitation with the treatment liquor in combination with the solid particulate material as a first phase of the treatment process. A second portion of the treatment liquor which may comprise one or more treatment agents and/or further additives can be added at a different time point in the treatment cycle. A series of treatment phases or stages can thus be conducted over the duration of the treatment cycle wherein the treatment liquor can be kept constant or varied for each respective phase.

The solid particulate material can be retained throughout the treatment cycle as portions of the treatment liquor are added as outlined above. Alternatively, the solid particulate material can be replaced prior to the addition of a further portion of the treatment formulation. This can be necessary to ensure that the animal skin substrate is not adversely affected by interactions occurring between incompatible chemical moieties. For example, chemical moieties which could potentially adhere to the solid particulate material following the introduction of one portion of the treatment liquor may not be compatible with chemical moieties present in a subsequent portion of the treatment liquor thus necessitating replacement of the solid particulate material before continuing the treatment cycle.

Each phase of the treatment cycle can comprise one or more agitation steps wherein the animal substrates are agitated with the solid particulate material and treatment liquor. After a given agitation step, the solid particulate material can be transferred from the treatment volume to the collecting volume and circulated back to the treatment volume along a circulation path in the manner described above. In this way, a further or subsequent agitation step can be carried out with the same solid particulate material.

The duration of the treatment cycle can be any period from 1 minute to 100 hours and in other embodiments the duration of the treatment cycle can be from 1 minute to 48 hours. Where the treatment cycle comprises more than one phase, each respective phase of the treatment cycle can be any period of 30 seconds or greater or 1 minute or greater wherein the sum of the respective phases comprises the total duration of the treatment cycle. Each respective phase of the treatment cycle can be a period of from 30 seconds to 10 hours.

The apparatus and method of the invention facilitates a considerable reduction in the duration of a typical treatment cycle as the presence of the solid particulate material enhances the effect or degree of mechanical action performed on the animal substrate. Furthermore, as the apparatus and method of the invention enables a reduction in the quantity of water or liquor needed in the drum, the effective concentration of chemicals dissolved in the treatment liquor is increased thereby resulting in faster mass transfer to the animal skin substrate(s) leading to a reduction in the duration of the treatment cycle time. Thus the duration of each phase of the process can be reduced leading to a typical reduction of 20 to 50% of the total duration of the treatment cycle when compared to the methods employed in the prior art.

Optionally, the mechanical action performed on the animal skin substrate by virtue of agitation with the solid particulate material is never sufficient to break up the animal substrate. Optionally, the solid particulate material does not penetrate the surface of the animal substrate.

The solid particulate material of the invention can thus be re-used one or more times for treatment of the animal substrates in a single treatment cycle or in subsequent treatment cycles. In this context, a single "use" of the solid particulate material equates to a single agitation step as performed in the treatment volume with the animal skin substrates. Preferably, the solid particulate material can be re-used at least two, three, four, five or more times, such as 10, 20, 50 or 100 or more times. The solid particulate material is typically not reused more than 10,000 or more than 1,000 times.

The solid particulate material can be subject to a cleaning operation. Intermittent cleaning of the solid particulate material is often desirable when the solid particulate material is re-used. Preferably, the cleaning of the solid particulate material is conducted within the processing system 60. Alternatively, the cleaning of the solid particulate material can be carried out within the drum 10 or within the storage vessel 40. Cleaning can be helpful in preventing unwanted contaminants from building up and/or in preventing treatment components from degrading and then depositing on the animal substrate. The particle cleaning step can be performed, for example, after every 10, after every 5, after every 3, after every 2 or after every 1 agitation step(s). The cleaning step can comprise washing the solid particulate material with a cleaning formulation. The cleaning formulation can be a liquid medium such as water, an organic solvent or a mixture thereof. Preferably, the cleaning formulation can comprise at least 1 wt %, preferably 10 wt %, more preferably at least 30 wt %, even more preferably at least 50 wt %, especially at least 80 wt % water, more especially at least 90 wt % water. The cleaning formulation can comprise one or more cleaning agents to aid the removal of any contaminants. Suitable cleaning agents can include surfactants, detergents, bleaching agents (e.g. sodium hypochlorite), oxidizing agents (e.g. hydrogen peroxide), dye transfer agents, biocides, fungicides, builders, acids, bases (e.g. sodium hydroxide and ammonium hydroxide), reducing agents and metal chelating agents. In alternative embodiments gaseous cleaning agents can be used such as ammonia and ozone. The solid particulate material can be cleaned at a temperature of from 0 to 40° C. for energy economy but for even better cleaning performance temperatures of from 41 to 100° C. can be used. The cleaning times can generally be from 1 second to 10 hours, typically from 10 seconds to 1 hour and more typically from 30 seconds to 30 minutes. The cleaning formulation can be acidic, neutral or basic depending on the pH which best provides for cleaning of the specific components circulated from the drum 10.

As noted above, the solid particulate material can be subjected to a cleaning operation within the drum 10. In such embodiments, after an agitation step with treatment liquor and solid particles has been completed, the treatment liquor can first be drained from the drum 10 and then cleaning formulation introduced to the drum 10. The cleaning formulation can comprise water and/or any of the cleaning agents described above. Following the introduction of the cleaning formulation, the solid particles can be agitated within the drum. After the cleaning operation has been completed, the solid particles can be re-used for additional agitation and/or treatment steps. Conducting a cleaning operation in this manner can be particularly advantageous for tanning processes which may include tanning agents in the treatment liquor. Thus any unreacted tanning agent can be washed from the solid particles and the animal skin substrates which enables an increase in the pH and removal of surplus salt. The increase in pH provides improved conditions for conducting subsequent processes such as retanning and/or dyeing treatments.

Alternatively, the solid particulate material can be removed from the apparatus 100 and cleaned before its re-use in an additional phase of the treatment process. The solid particulate material can be replaced before commencing an additional phase in the treatment process.

The apparatus 100 can include means to facilitate the easy removal of the solid particulate material after the end of a phase in the treatment process or after completion of the treatment process. The apparatus 100, and preferably the drum 10, can thus include a vacuum, a blower, a magnet or other appropriate apparatus to facilitate solid particle removal.

The apparatus 100 can further comprise one or more blowing and/or sucking devices to promote conveyance of the solid particles along the circulation path(s).

The solid particulate material employed in the apparatus and process of the invention can comprise a multiplicity of polymeric or non-polymeric particles. Most preferably, the solid particulate material can comprise a multiplicity of polymeric particles. Alternatively, the solid particulate material can comprise a mixture of polymeric particles and non-polymeric particles. Alternatively, the solid particulate material can comprise a multiplicity of non-polymeric particles. Thus the solid particulate material of the invention can comprise exclusively polymeric particles, exclusively non-polymeric particles or mixtures of polymeric and non-polymeric particles in any desired relative amounts. Throughout this disclosure wherever a ratio is quoted with respect to polymeric and/or non-polymeric particles this will be understood as a reference to the sum total of polymeric and/or non-polymeric particles that may constitute the solid particulate material.

The polymeric or non-polymeric particles are of such a shape and size as to allow for good flowability and intimate contact with the animal skin substrate. A variety of shapes of particles can be used, such as cylindrical, spherical, ellipsoidal, spheroidal or cuboid; appropriate cross-sectional shapes can be employed including, for example, annular ring, dog-bone and circular. Ellipsoidal, spheroidal or spherical solid particles are particularly preferred. The particles can have smooth or irregular surface structures and can be of solid, porous or hollow construction. Non-polymeric particles comprising naturally occurring materials such as stone may have various shapes, dependent on their propensity to cleave in a variety of different ways during manufacture. Most preferably, however, said particles can comprise cylindrical, ellipsoidal, spheroidal or spherical beads.

The multiplicity of solid particles employed in the invention are preferably of such a size as to have an average mass in the region of 1 mg to 500 g, more preferably from 1 mg to 100 g, more preferably from 1 mg to 1 g and most preferably 5 mg to 100 mg.

The multiplicity of solid particles of the invention can be chemically modified to include additional moieties. Thus the particles can be chemically modified to further include one or more moieties selected from the group consisting of: enzymes, oxidizing agents, catalysts, metals, reducing agents, chemical cross-linking agents and biocides.

The polymeric particles can comprise polyalkenes such as polyethylene and polypropylene, polyamides, polyesters, polysiloxanes or polyurethanes. Furthermore, said polymers can be linear, branched or crosslinked. Said polymeric particles can comprise polyamide or polyester particles, particularly particles of nylon, polyethylene terephthalate or polybutylene terephthalate, typically in the form of beads. Copolymers of the above-polymeric materials can also be employed for the purposes of the invention. The properties of the polymeric materials can be tailored to specific requirements by the inclusion of monomeric units which confer particular properties on the copolymer. Various nylon homo- or co-polymers can be used including, but not limited to, Nylon 6 and Nylon 6,6. The nylon can comprise Nylon 6,6 copolymer, preferably having a molecular weight in the region of from 5000 to 30000 Daltons, more preferably from 10000 to 20000 Daltons, most preferably from 15000 to 16000 Daltons. The polyester can typically have a molecular weight corresponding to an intrinsic viscosity measurement in the range of from 0.3 to 1.5 dl/g, as measured by a solution technique such as ASTM D-4603. Said polymeric particles can comprise synthetic or natural rubber.

The polymeric particles can have an average density of about 0.5 g/cm$^3$ to about 3.5 g/cm$^3$. Polymeric particles having an average density of 0.5 to 2.5 g/cm$^3$ can be particularly suitable. Polymeric particles having an average density of 0.5 to less than 1 g/cm$^3$ can be particularly suitable.

The polymeric or non-polymeric particles can be solid, porous or hollow.

The solid particulate material can comprise non-polymeric particles. In such embodiments, the non-polymeric particles can comprise ceramic material, refractory material, igneous, sedimentary or metamorphic minerals, composites, metal, glass or wood. Suitable metals include, but are not limited to, zinc, titanium, chromium, manganese, iron, cobalt, nickel, copper, tungsten, aluminium, tin, and alloys thereof (such as steel). Suitable ceramics can include, but are not limited to, alumina, zirconia, tungsten carbide, silicon carbide and silicon nitride.

The non-polymeric particles may have an average density of 0.5 to 20 g/cm$^3$, more preferably from 2 to 20 g/cm$^3$, especially from 4 to 15 g/cm$^3$ and most especially from 4 to 10 g/cm$^3$.

In order to provide lubrication for the treatment system, the or each animal skin substrate can be moistened. This can be achieved by wetting the substrates with water by contact with mains or tap water for example. Wetting of the substrates within the apparatus of the invention is however preferable. The wetting of the substrates can be carried out so as to achieve a water to animal skin substrate ratio of between 1000:1 and 1:1000 w/w. Typically, the ratio of water to animal skin substrate can be from 1:100 to 1:1 w/w more typically from 1:50 to 1:2 w/w, especially typically from 1:40 to 1:2 w/w, more especially typically from 1:20 to 1:3 w/w and most typically from 1:15 to 1:5 w/w. The ratio of water to animal skin substrate can be at least 1:40 w/w, at least 1:30 w/w, at least 1:20 w/w or at least 1:15 w/w. The ratio of water to animal skin substrate can be no more than 10:1 w/w, no more than 5:1 w/w, no more than 2:1 w/w or no more than 1:1 w/w.

It may be desirable that no further water is added to the animal skin substrate other than that present in the animal skin substrate(s) as a result of prior treatment methods. Thus, the treatment liquor can be formed by adding a "neat" treatment agent or combination of "neat" treatment agents to the treatment volume 14 of the drum 10. In this context "neat" preferably means only the active or efficacious component of the treatment agent is added and is thus introduced to the treatment volume without further liquid diluents such as water, organic liquids and the like. The treatment agent can be added to the treatment volume in the form of a dry powder or alternatively as a liquid containing only the active component. The liquid (especially water) already present in the prewetted or premoistened animal skin substrate is therefore sufficient to form the treatment liquor "in situ" within the drum. Advantageously, this approach can ensure the amount of liquid or water used is the treatment process is even lower. Also, it has been found that this approach can lead to a further improvement in the treatment in terms of uniformity, depth of penetration and in terms of the percentage of treatment agents which are incorporated into the animal skin substrate. In this way the resulting animal skin substrate after treatment is of a better quality (having improved chemical, physical or aesthetic properties) and the amounts of treatment agents remaining in the liquor after the treatment method is complete are even further reduced.

The weight ratio of animal skin substrate(s):solid particulate material is preferably from 10:1 to 1:10, more preferably from 5:1 to 1:5, preferably from 3:1 to 1:3, preferably from 2:1 to 1:2. Preferably, the weight of the animal skin substrate for this ratio is based on the wet weight of the animal skin substrate. The wet weight of the animal skin substrate used herein preferably refers to any latent fluid (typically water) present within the animal skin substrate itself.

Preferably, throughout this invention the dry weight of a wet substrate is from 25 to 75 wt % of the wet weight, typically about 50 wt %. So for example, 2 Kgs of wet animal skin substrate comprises 1 Kg of dry animal substrate.

The weight ratio of the animal skin substrate(s):fluid (especially water) is preferably from about 1:5 to about 100:1, typically from about 1:2, typically from about 1:1, and typically from about 2:1, typically from about 3:1 and typically from about 5:1, typically no more than about 40:1, typically no more than about 30:1, typically no more than about 20:1, and typically no more than about 15:1. Preferably the weight of the animal skin substrate is based on the wet weight of the animal skin substrate.

The weight ratio of the dry animal skin substrate:fluid is preferably from 10:1 to 1:10, more preferably 7:1 to 1:7, even more preferably 4:1 to 1:4, yet more preferably 3:1 to 1:3 and most preferably 2:1 to 1:2 by weight.

Preferably, the ratio of the treatment volume of the drum (in m$^3$):to the weight of fluid in the drum (in metric tonnes) is from about 1:100 to about 100:1.

Preferably, the ratio of the treatment volume of the drum (in m$^3$):to the weight of fluid in the drum (in metric tonnes) is in order of increasing preference at least 1:4, 1:3, 1:2, 1:1, 2:1, 3:1, 4:1, 5:1, 10:1, 20:1, 25:1, 30:1, 35:1, 40:1, 45:1, 50:1, 60:1 and 70:1.

The ratio of the treatment volume of the drum (in m$^3$):to the weight of fluid in the drum (in metric tonnes) can be, in order of increasing preference, no more than about 75:1, no more than 60:1, no more than 50:1, no more than 40:1, no more than 30:1, no more than 25:1, no more than 20:1 and no more than 15:1.

The treatment liquor employed by the present invention can comprise a liquid medium and preferably comprises water or water when combined with at least one treatment agent and/or any further additives as detailed hereinbelow. The composition of the treatment liquor may depend at any given time on the point which has been reached in the treatment process. Thus, for example, at the start of the treatment process, the treatment liquor may be water. At a later point in the treatment process the treatment liquor may include one or more treatment agents and/or one or more further additives. Alternatively, one or more treatment agents and/or one or more further additives may be added in combination with water at the start of the treatment process. During the treatment process, the treatment liquor may also include suspended soil and/or particulate deposits removed from the animal substrate.

The treatment liquor can be aqueous. The treatment liquor can comprise at least 0.1% w/w water or at least 1% w/w water or at least 5% w/w water or between 5% and 99.9% w/w water. The treatment liquor can comprise not more than 99.9% w/w water.

Treatment liquor can comprise water alone or it can comprise water and one or more organic solvents. The organic solvents may be water-miscible. Preferred organic solvents can be alcohols, glycols and amides. In certain embodiments, the treatment liquor comprises at least 10 wt %, more preferably at least 50 wt %, especially at least 80 wt %, more especially at least 90 wt % and most especially at least 95 wt % of water. The treatment liquor comprises preferably less than 10 wt %, more preferably less than 10 wt % organic solvents. In some embodiments no organic solvents are present in the treatment liquor other than trace amounts from impurities in other components of the treatment liquor.

The treatment process performed on the animal skin substrate can comprise a cleaning step. The cleaning step can be performed prior to a chemical modification of the substrate. Cleaning may be necessary to remove any unwanted materials adhered to the exterior of the animal substrate. The treatment liquor used in the cleaning step can comprise one or more enzymes. The treatment liquor can comprise proteolysis enzymes. In order to enhance cleaning of the animal skin substrate, in particular in a cleaning step, the treatment liquor can comprise one or more surfactants. Preferably, the treatment liquor can comprise non-ionic surfactants.

The treatment process can comprise one or more additional steps to remove further unwanted materials from the animal substrate. For example, the animal skin substrate can be subject to liming and deliming. In such embodiments, the treatment liquor, at least for such additional steps, can comprise reducing agents, bases, acids and/or neutralizing agents.

The treatment liquor of the invention can comprise one or more components effective to modify the animal skin substrate in some way and optionally impart certain properties to the modified substrate. Thus the treatment liquor can contain ingredients which perform a cleaning function and ingredients that elicit other effects such as chemical modification of the substrate. The treatment liquor of the invention can comprise one or more components selected from the group consisting of: solvents, surfactants, cross-linking agents, metal complexes, corrosion inhibitors, complexing agents, biocides, builders, catalysts, chelating agents, dispersants, perfumes, optical brightening agents, enzymes, dyes, pigments, oils, waxes, waterproofing agents, flame retardants, stain repellants, reducing agents, acids, bases, neutralizing agents, polymers, resins, oxidising agents and bleaches.

Suitable surfactants for use in the treatment liquor can be selected from non-ionic and/or anionic and/or cationic surfactants and/or ampholytic and/or zwitterionic and/or semi-polar nonionic surfactants.

Suitable builders can be included in the treatment liquor and these include, but are not limited to, the alkali metal, ammonium and alkanolammonium salts of polyphosphates, alkali metal silicates, alkaline earth and alkali metal carbonates, aluminosilicates, polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid and soluble salts thereof.

Optionally, the treatment liquor can also contain dispersants. Suitable water-soluble organic materials are the homo- or co-polymeric acids or their salts, in which the polycarboxylic acid may comprise at least two carboxyl radicals separated from each other by not more than two carbon atoms.

Optionally, the treatment liquor can also contain perfumes. Suitable perfumes can generally be multi-component organic chemical formulations which can contain alcohols, ketones, aldehydes, esters, ethers and nitrile alkenes, and mixtures thereof. Commercially available compounds offering sufficient substantivity to provide residual fragrance include Galaxolide (1,3,4,6,7,8-hexahydro-4,6,6,7,8,8-hexamethylcyclopenta(g)-2-benzopyran), Lyral (3- and 4-(4-hydroxy-4-methyl-pentyl) cyclohexene-1-carboxaldehyde and Ambroxan ((3aR,5aS,9aS,9bR)-3a,6,6,9a-tetramethyl-2,4,5,5a,7,8,9,9b-octahydro-1H-benzo[e][1] benzofuran). One example of a commercially available fully formulated perfume is Amour Japonais supplied by Symrise® AG.

The treatment liquor can include an optical brightening agent. Suitable optical brighteners which can be included in the treatment liquor fall into several organic chemical classes, of which the most popular are stilbene derivatives, whilst other suitable classes include benzoxazoles, benzimidazoles, 1,3-diphenyl-2-pyrazolines, coumarins, 1,3,5-triazin-2-yls and naphthalimides. Examples of such compounds can include, but are not limited to, 4,4'-bis[[6-anilino-4(methylamino)-1,3,5-triazin-2-yl]amino]stilbene-2,2'-disulphonic acid, 4,4'-bis[[6-anilino-4-[(2-hydroxyethyl)methylamino]-1,3,5-triazin-2-yl]amino] stilbene-2,2'-disulphonic acid, disodium salt, 4,4'-Bis[[2-anilino-4-[bis(2-hydroxyethyl)amino]-1,3,5-triazin-6-yl] amino]stilbene-2,2'-disulphonic acid, disodium salt, 4,4'-bis [(4,6-dianilino-1,3,5-triazin-2-yl)amino]stilbene-2,2'-disulphonic acid, disodium salt, 7-diethylamino-4-methylcoumarin, 4,4'-Bis[(2-anilino-4-morpholino-1,3,5-triazin-6-yl)amino]-2,2'-stilbenedisulphonic acid, disodium salt, and 2,5-bis(benzoxazol-2-yl)thiophene.

The treatment process of the invention can comprise a step wherein the animal skin substrate is agitated with a treatment liquor comprising one or more oils. The inclusion of one or more oils in the treatment liquor can impart specific properties to the substrate. The treatment liquor can comprise oils with at least one sulphur moiety such as sulphated and/or sulphited oils to provide softness and flexibility to the animal substrate. In other embodiments, oils can be included to provide anti-static control, reduce friction and/or to improve lubrication.

Suitable acids which can be contained in the treatment liquor include, but are not limited to, sulphuric acid, formic acid and ammonium salts (e.g. ammonium sulphate and ammonium chloride). Suitable bases can include, but are not limited to, calcium hydroxide and sodium hydroxide. Suitable neutralizing agents include, but are not limited to, sodium carbonate and sodium bicarbonate.

Enzymes that can be used in the treatment liquor can include, but are not limited to, hemicellulases, peroxidases, proteases, carbonic anhydrases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, [beta]-glucanases, arabinosidases, hyaluronidase, chondroitinase, laccase, amylases and mixtures thereof.

Dyes that may be used in the treatment liquor can include, but are not limited to, anionic, cationic, acidic, basic, amphoteric, reactive, direct, chrome-mordant, pre-metallised and sulphur dyes.

The treatment liquor can include one or more bleaches and/or oxidizing agents. Examples of such bleaches and/or oxidizing agents can include, but are not limited to, ozone, peroxygen compounds, including hydrogen peroxide, sodium hypochlorite, inorganic peroxy salts, such as perborate, percarbonate, perphosphate, persilicate, and mono persulphate salts (e.g. sodium perborate tetrahydrate and sodium percarbonate), and organic peroxy acids such as peracetic acid, monoperoxyphthalic acid, diperoxydodecanedioic acid, N,N'-terephthaloyl-di(6-aminoperoxycaproic acid), N,N'-phthaloylaminoperoxycaproic acid and amidoperoxyacid. The bleaches and/or oxidizing agents can be activated by a chemical activation agent. Activating agents can include, but are not limited to, carboxylic acid esters such as tetraacetylethylenediamine and sodium nonanoyloxybenzene sulphonate. Alternatively, the bleach compounds and/or oxidizing agents can be activated by heating the treatment liquor.

Preferably, the treatment process of the invention includes one or more chemical modification steps in order to colour the substrate. Thus, the treatment liquor can include at least one colourant. The colourant can be selected from, for example, one or more dyes, pigments, optical brighteners or mixtures thereof.

The colourant can be one or more dyes selected from anionic, cationic, acidic, basic, amphoteric, reactive, direct, chrome-mordant, pre-metallised and sulphur dyes.

The solid particulate material can be substantially uncoated with one, several or all components of the treatment liquor (excluding of course water). In particular, prior to at least a first agitation step it is preferred that the solid particulate material is not coated with a colourant (e.g. a dye or a pigment). The treatment liquor and the solid particulate material can be premixed prior to the agitation step but this is preferably under conditions which do not promote or cause the colourant to coat the particles of the solid particulate material. So for example, the colourant can be a dye which is soluble in the treatment liquor, e.g. having a solubility of greater than 1 g per liter, more preferably greater than 2 g per liter and especially greater than 5 g per liter of the treatment liquor, and/or additional organic solvents can be added to the water in the treatment liquor to promote solubility of the dye, and/or the solid particulate material can be chosen which specifically has no affinity with the dye. Suitable organic solvents can include water-miscible alcohols, glycols, amides and the like. When the colourant is insoluble or only partially soluble in the treatment liquor it is preferred that the colourant is dispersed with one or more dispersants. These can be cationic, anionic or non-ionic dispersants. Coating of the solid particulate material may be prevented or inhibited by having dispersants of the same type which stabilize both the solid particulate material and the colourant during the agitation step. For example both the colourant and the solid particulate material can be dispersed with an anionic dispersant, both can be dispersed with a cationic dispersant or both can be dispersed with a non-ionic dispersant. When dispersing the colourant it is preferably a pigment, an insoluble dye or a slightly soluble dye (<1 g liter) dye. When the colourant is dispersed or dissolved in the treatment liquor in the presence of the particulate solid this is preferably done below 30° C., more preferably below 25° C. Using lower temperatures tends to reduce the possibility for coating the solid particulate material.

The colourant can be dispersed or dissolved in the treatment liquor. The colourant can be dispersed or dissolved in the treatment liquor in the absence of the solid particulate material. This can help to prevent any possibility that the colourant pre-coats the solid particulate material. The solid particulate material can then be added prior to or during agitation. Alternatively, the colourant can be dispersed or dissolved in an aqueous liquid medium (again in the absence of the solid particulate material) and then added to the treatment liquor.

A mixture of the treatment liquor containing a colourant and the solid particulate material can be such that substantially no coating of the solid particulate material results and the colourant does not penetrate into the solid particulate material. This can be determined by: i. adding 100 g of solid particulate material to 100 g of water containing 2 wt % of colourant; ii. stirring the mixture for 1 hour at 25° C.; iii. removing the solid particulate material from the water by means of filtration; iv. measuring the amount of colourant remaining in the water (e.g. by colourimetic, UV, refractive index or gravimetric analysis); and v. calculating the amount of colourant which has not coated or penetrated the solid particulate material.

Preferably, this value should mean that greater than 90 wt %, more preferably greater than 95 wt %, especially greater than 98 wt % and more especially greater than 99 wt % of the colourant remains in the water. Preferably, the water is at pH 7.

The treatment liquor can comprise a colourant and the treatment process can comprise applying the colourant to the animal skin substrate wherein at least some of the colourant so applied originates from the treatment liquor. Typically, at least some, more typically essentially all of the colourant so applied was, prior to application, physically separate from the solid particulate material. Preferably, at least 50 wt %, more preferably at least 70 wt %, especially at least 90 wt %, more especially at least 99 wt % and most especially essentially all the colourant which is applied to the animal skin substrate originates from the treatment liquor (and not from the surface or interior of the solid particulate material). Preferably, during the method which comprises applying a colourant to the animal skin substrate there is no measurable net loss of colourant from the solid particulate material. This shows that essentially all of the colour applied to the animal skin substrate originates from the treatment liquor. Typically, the amount of colourant in or coating the particulate solid will remain constant or may just slightly rise during the agitation process.

The treatment liquor can have a basic (>7), an acidic (<7) or neutral (7) pH. It can be desirable that the pH of the treatment liquor in certain treatment steps or stages is acidic. The acidic pH is typically less than 6.9, more typically less than 6.5, even more typically less than 6 and most typically less than 5.5. The acidic pH is typically no less than 1, more typically no less than 2 and most typically no less than 3. The pH or the treatment liquor can differ at different times, points or stages in the treatment process according to the invention. Preferably, the treatment liquor has the above typical pH value for at least some time during the agitation.

Before or after said agitating the animal skin substrate with a treatment liquor and a solid particulate material, the methods of the present invention can include any one or more of the following steps used in the production of leather including: curing, fat liquoring, scudding, preserving, fleshing, splitting, soaking, liming, deliming, reliming, unhairing, bating, degreasing, frizzing, bleaching, pickling, depickling, pretanning, tanning, retanning, tawing, crusting, coating and dyeing and finishing.

Preferably, said treatment process is a tannery process and said treatment liquor comprises at least one treatment agent selected from tanning agents, re-tanning agents and tannery process agents.

The apparatus and method of the invention can facilitate a considerably higher level of incorporation of treatment agents such as tanning agents into the animal skin substrate thereby reducing the amount of chemicals wasted to effluent. The reduction of chemicals lost to effluent may be 10-50% w/w of the chemicals typically used in the methods employed in the prior art.

Preferably, said tannery process is selected from one or more of cleaning, curing, beamhouse treatments, tanning, re-tanning, fat liquoring, enzyme treatment, dyeing and dye fixing.

Preferably, the treatment process of the invention is a process used in the production of leather and can include one or more of: curing, beamhouse treatments, fat liquoring, pretanning, tanning, retanning, tawing, crusting and dyeing.

As used herein beamhouse treatments can include soaking, liming, deliming, reliming, unhairing, fleshing, bating, degreasing, scudding, bating, pickling and depickling.

Preferably, the tanning agent and/or tannery processing agents can be selected to chemically modify the animal substrate, such as, for example, by linking and locking collagen protein strands of the animal skin substrate together. The three dimensional protein structure of the animal skin substrate can be modified.

Advantageously, the apparatus and method of the invention can facilitate a deeper and more uniform penetration of tanning agents into the animal skin substrate thereby improving the preservation of the substrate compared to the methods used in the prior art.

Preferably, the process of the invention comprises applying the tanning agent or tannery process agent to the animal skin substrate wherein at least some of the tanning agent or tannery process agent so applied originates from the treatment liquor. More preferably substantially all of the tanning agent or tannery process agent so applied originates from the treatment liquor.

Preferably, the tanning or re-tanning agent can be selected from synthetic tanning agents, vegetable tanning or vegetable re-tanning agents and mineral tanning agents such as chromium III salts or salts and complexes containing iron, zirconium, aluminium and titanium. In some embodiments all the tanning agents used are substantially free from chromium containing compounds.

The tanning agents can be synthetic tanning agents. Suitable synthetic tanning agents include, but are not limited to amino resins, polyacrylates, fluoro and/or silicone polymers and formaldehyde condensation polymers based on phenol, urea, melamine, naphthalene, sulphone, cresol, bisphenol A, naphthol and/or biphenyl ether.

The tanning agents can be vegetable tanning agents. Vegetable tanning agents comprise tannins which are typically polyphenols. Vegetable tanning agents can be obtained from plant leaves, roots and especially tree barks. Examples of vegetable tanning agents can include the extracts of the tree barks from chestnut, oak, redoul, tanoak, hemlock, quebracho, mangrove, wattle acacia; and myrobalan.

The tanning agents can be mineral tanning agents. Particularly suitable mineral tanning agents comprise chromium compounds, especially chromium salts and complexes. The chromium is preferably in a chromium (Ill) oxidation state. A preferred chromium (Ill) tanning agent is chromium (Ill) sulphate.

Other tanning agents can include aldehydes (glyoxal, glutaraldehyde and formaldehyde), phosphonium salts, metal compounds other than chromium (e.g. iron, titanium, zirconium and alumunium compounds). The treatment liquor, especially for tanning, can be acidic, neutral or basic. Vegetable and chromium tanning agents are preferably used with acidic treatment formulations. The treatment liquor can preferably comprise sulfuric, hydrochloric, formic or oxalic acid in embodiments where acidic formulations are to be used.

Optionally, water in the treatment liquor has been softened or demineralized.

The treatment liquor can include one or more waterproofing agents. Examples of suitable waterproofing agents are hydrophobic silicones. The treatment liquor can include one or more flame retardants. Suitable flame retardants can include, but are not limited to, titanium hexfluoride or zirconium hexafluoride. The treatment liquor can include one or more stain repellants. Suitable stain repellants can include, but are not limited to, polysulphones, waxes, salts, silicone polymers and polytetrafluoroethylene (PTFE).

As the process of the invention can be used with significantly less water than methods of the prior art, the quantity of chemicals or chemical loading in the treatment liquor can be reduced.

One or more phases of the treatment process of the invention can be performed at a temperature of from 0 to 100° C. Furthermore, the treatment process can include one or more heating or cooling steps. Thus the temperature may be raised or lowered between the values of 0 and 100° C. at one or more points throughout the treatment cycle. One or more phases of the method can be performed at a temperature of from 0 to 60° C. such as from 20 to 60° C., or at a temperature of from 30 to 50 or 60° C. As the method of the invention can lead to a reduction in the duration of the treatment cycle, it is possible for the treatment process to be carried out effectively at lower temperatures. For example, in one or more phases of the treatment cycle the treatment process can effectively be performed at ambient temperature as opposed to higher temperatures which are generally required in the processes of the prior art. Also, because smaller amounts of treatment liquor can be used the amount of energy required to obtain these temperatures can be substantially reduced.

An exemplary treatment process utilizing the apparatus 100 of the invention can now be outlined. First, the animal skin substrate is placed within the treatment volume 14 of the drum 10 via access means 12. After the access means 12 is closed, treatment liquor together with any treatment agents are introduced to the treatment volume 14 through drum inlet 18 (or alternatively through drum inlet 17). In addition, solid particulate material 30 residing in storage vessel 40 is introduced to the treatment volume through drum inlet 17. Treatment liquor and solid particulate material fills the treatment volume 14 of the drum but allows for typically 30 to 60% ullage by volume in order to provide for efficient mixing whilst maximising the utilisation capacity of the treatment process. Rotation of the drum 10 ensures agitation of the animal skin substrate with the treatment liquor and the solid particulate material within the treatment volume 14. During the course of agitation, treatment liquor and solid particulate material is caused to flow through the apertures in partition 22 from the treatment volume 14 to the collecting volume 20. Flow of treatment liquor and solid particulate material through the partition 22 is facilitated by the action of pumping device 50 located downstream of the collecting volume 20. The drum 10 is preferably mounted about an axis which is inclined to the horizontal. Inclination of the drum promotes an advantageous fluid flow of treatment liquor around the substrate as the drum rotates which can aid the displacement of any solid particulate material that may become adhered to the surface of the substrate.

Following its passage into the collecting volume 20, treatment liquor together with the solid particulate material is conveyed along conduit 26 to the processing system 60. The solid particulate material is separated from the treatment liquor within the processing system 60 by the action of a separator. The inclusion of a blowing and/or sucking device within the processing system 60 can enhance the separation of solid particles from the treatment liquor. Unwanted solids entrained in the treatment liquor flow with the solid particulate material, are also extracted and exit the processing system 60 via first drain 65. Waste treatment liquor and effluent generated as a result of the treatment process is removed via second drain 67. The solid particulate material can be subject to one or more washing and rinsing operations by a device within the processing system 60 before being recycled to the upper portion of the drum 10 for re-introduction to the treatment volume 14 and therefore re-use in the treatment procedure.

In addition, treatment liquor can be conveyed from the collecting volume 20 along conduit 26 to be recycled via the processing system 60. A portion or all of the treatment liquor recycled from the collecting volume 20 can be re-introduced to the upper portion of the drum 10 from the processing system 60 via conduit 18A and drum inlet 18. The further introduction of treatment liquor can advantageously serve to "wash off" or displace any solid particles adhered to the surface of the animal skin substrates. At an appropriate stage in the treatment process when sufficient agitation with the solid particles is deemed to have occurred, the re-introduction of solid particles into the treatment volume 14 can be ceased. With the flow of solid particles into the treatment volume arrested, the drum 10 can continue to rotate and further treatment liquor introduced into the treatment volume to displace any remaining solid particles that have not passed through the partition 22 into the collecting volume 20. Further (or recycled) treatment liquor can continue to be introduced in this manner for a predetermined period or until a desired separation of solid particles from the substrates has been achieved.

Depending on the treatment process performed, the drum can be rotated at different speeds. Typically, for tannery processes, the drum is caused to rotate at a speed of from about 1 to about 50 rpm, preferably from about 1 to about 30 rpm, and preferably from about 1 to 15 rpm. Particularly wherein the treatment process is a beamhouse or a tanning or a retanning or a fatliquoring or a dyeing process, the drum can be caused to rotate at a speed of from about 3 to about 14 rpm. Particularly wherein the treatment process is a beam house process, the drum can be caused to rotate at a speed of from about 9 to about 14 rpm. The drum can be caused to rotate at a speed of not more than 15 rpm or a lower rpm.

Advantageously, the treatment process when performed in accordance with the invention demonstrated highly efficient separation of solid particles from the animal skin substrates. The extent of separation of solid particles from the animal skin substrates can be determined by calculating the separation efficiency. The separation efficiency can preferably be calculated by the following steps:

i. recovering the particulate solid material following its use in the treatment process carried out in the apparatus of the present invention or in the method(s) of the present invention;
ii. rinsing and drying the particulate solid materials recovered in step i);
iii. recording the weight of recovered particulate solid material—A;
iv. recovering the particulate solid material which remains after step i);
v. rinsing and drying the particulate solid materials recovered in step iv);
vi. recording the weight of recovered particulate solid material—B;
vii. calculating the percentage efficiency by use of the equation: Separation Efficiency (wt %)=100×A/(A+B).

Preferably, step iv is performed by manually hand picking and shaking the remaining particulate solid material from the animal skin substrate. The rinsing steps are useful for removing any animal skin substrate and treatment liquor residues. Preferably, this is done by water rinsing.

The separation efficiency of solid particles from the animal skin substrate provided by the invention may be greater than 90%. Furthermore, separation efficiencies of greater than 95% and greater than 99% and 99.95% were shown to be possible.

The above-noted processes employing the apparatus 100 can constitute a primary means of removing solid particulate material from animal skin substrates. Although the vast majority (i.e. greater than 90%) of solid particles are typically removed from the animal skin substrates using the apparatus 100, any remaining solid particles can be removed by one or more further process steps. Thus, the invention also relates to secondary means of removing solid particulate material from animal skin substrates.

Figure 2:
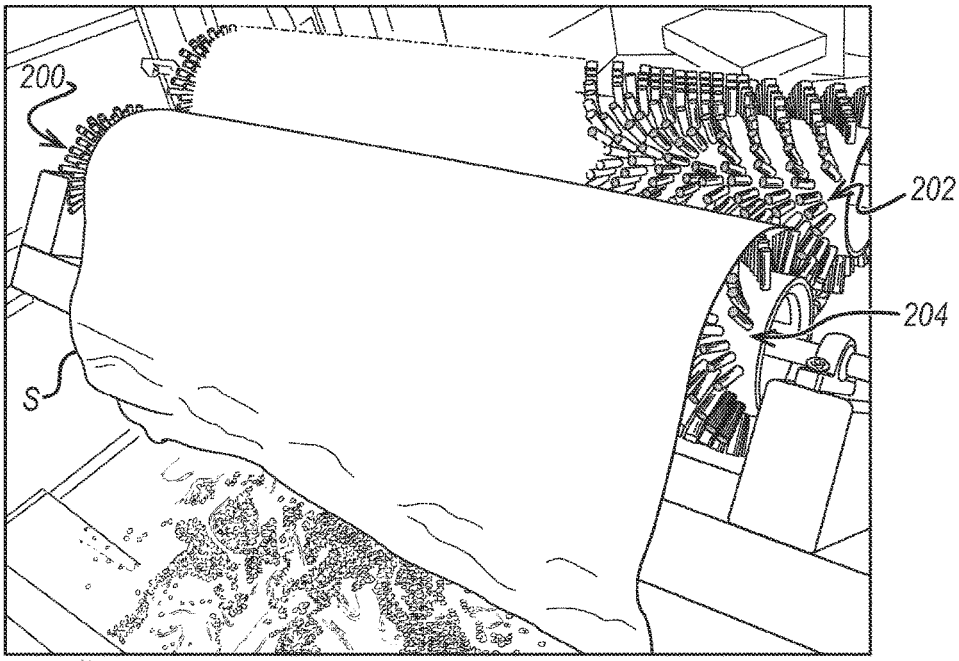
FIG. 2 is an image showing a further apparatus for removing solid particulate material from animal skin substrates according to an embodiment of the invention.

FIG. 2 illustrates a further apparatus 200 for removing solid particulate material from animal skin substrates. Particularly, the apparatus 200 can be used as a part of a secondary solid particulate material removal process following the treatment of the substrates in the apparatus 100. The apparatus 200 comprises first and second rollers 202, 204 between which the animal skin substrate (S) can be fed. Thus after recovery from the treatment apparatus 100, the substrates are flattened and unfolded before being passed between the rollers. Each roller can be in the form of a generally cylindrical brush having a plurality of bristles upstanding from the surface of a generally cylindrical core. As the animal skin substrate (S) is fed between the rollers, the brushes of the first roller 202 contact a lower surface of the animal skin substrate and the brushes of the second roller 204 contact an upper surface of the animal skin substrate. In this way, the use of the apparatus 200 can strip any remaining solid particles from the substrate surfaces. The brushes can advantageously be caused to rotate relative to the animal skin substrate, such as by drive means. The drive means can be manual, or more preferably can be an electric motor.

Figure 3:
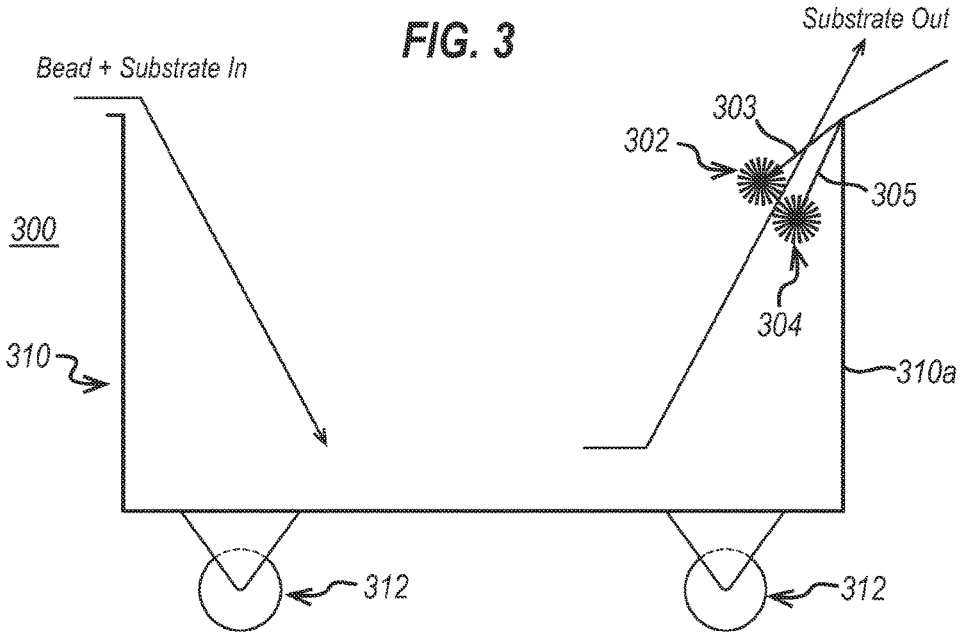
FIG. 3 shows a schematic front view of a further apparatus for removing solid particulate material from animal skin substrates according to an embodiment of the invention.

FIG. 3 illustrates a further apparatus 300 for removing solid particulate material from animal skin substrates. The apparatus 300 can also be used as a part of a secondary solid particulate material removal process following the treatment of the substrates in the apparatus 100. The apparatus 300 includes tub 310 which is conveniently mounted on a set of wheels 312. Apparatus 300 can thus be in the form of a trolley. The apparatus 300 comprises first and second rollers 302, 304 between which the animal skin substrate (S) can be fed. The first and second rollers 302, 304 can be of similar construction, that is, generally cylindrical brushes to the rollers 202, 204 mentioned above. The rollers are mounted to a portion of the tub 310 such that they are positioned inwardly with respect to tub sidewall 310*a*. Particularly, the rollers 302, 304 are respectively connected to roller supports 303, 305 extending from tub sidewall 310*a*.

After recovery from the treatment apparatus 100, the animal skin substrates are loaded into the tub 310. The animal skin substrate (S) can then be pulled between the rollers whereby brushes of the first roller 302 contact a lower surface of the animal skin substrate and the brushes of the second roller 304 contact an upper surface of the animal skin substrate. The brushes can advantageously be caused to rotate relative to the animal skin substrate, such as by drive means. The drive means can be manual, or more preferably can be an electric motor. Solid particulate material removed from the substrate in this manner falls into the interior of the tub 310 and can be retained for further use in additional treatment processes.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An apparatus for treating one or more animal skin substrates with a multiplicity of solid particles and treatment liquor comprising:

a rotatably mounted drum comprising an internal volume having a first portion defining a treatment volume for retaining said animal substrates and a second portion defining a collecting volume, wherein the side-walls of said drum are not perforate;

one or more inlets for introducing solid particles and treatment liquor into said treatment volume;

a partition separating said treatment volume from said collecting volume wherein said partition allows free passage of solid particles from the treatment volume to the collecting volume and prevents the passage of the substrate(s) therethrough;

a circulation path for conveying said solid particles from the collecting volume to the treatment volume; and a pumping device arranged to pump solid particles and said treatment liquor along a portion of said circulation path.

2. An apparatus as claimed in claim 1 wherein the circulation path provides a flow of solid particles from the collecting volume to the treatment volume and then to the collecting volume.

3. An apparatus as claimed in claim 1 wherein the circulation path provides a flow of treatment liquor from the collecting volume to the treatment volume and then to the collecting volume.

4. An apparatus as claimed in claim 1 comprising a processing system in said circulation path wherein said processing system receives said treatment liquor and said solid particles from the collecting volume of said drum.

5. An apparatus as claimed in claim 4 wherein said processing system comprises a separator configured to separate at least a portion of said treatment liquor from said solid particles.

6. An apparatus as claimed in claim 1 comprising a storage vessel for retaining said solid particles and a dispenser to introduce said solid particles to said treatment volume.

7. An apparatus as claimed in claim 1 wherein a first portion of the circulation path comprises a conduit having an inlet disposed proximate the lowermost part of the collecting volume, the conduit extending from said collecting volume.

8. An apparatus as claimed in claim 7 comprising a first such conduit provided for conveying solid particles.

9. An apparatus as claimed in claim 7 comprising one or more such conduits for conveying both treatment liquor and solid particles.

10. An apparatus as claimed in claim 1 wherein said drum has an upper portion comprising at least one inlet to introduce said solid particles into said treatment volume and at least one inlet for receiving treatment liquor into said treatment volume.

11. An apparatus as claimed in claim 6 wherein said drum has an upper portion comprising at least one inlet to introduce said solid particles into said treatment volume and at least one inlet for receiving treatment liquor into said treatment volume, and wherein said dispenser communicates with said at least one inlet of said upper portion to introduce said solid particles into said treatment volume.

12. An apparatus as claimed in claim 10 wherein said apparatus comprises a conduit extending from an outlet of the processing system wherein said conduit is connected to an inlet of the upper portion of the drum.

13. An apparatus as claimed in claim 5 wherein said processing system comprises a device for removing residual treatment liquor and deposits from said solid particles.

14. An apparatus as claimed in claim 5 wherein said processing system comprises one or more outlets for discharging treatment liquor and/or unwanted matter produced during the treatment process.

15. An apparatus as claimed in claim 1 wherein said drum comprises a closure moveable between an open position and a closed position wherein when said closure is moved to said open position free passage of solid particles and fluids into the collecting volume from the treatment volume is permitted and wherein when said closure is moved to said closed position solid particles are prevented from passing into the collecting volume from the treatment volume whilst the passage of fluids into the collecting volume from the treatment volume is permitted.

16. An apparatus as claimed in claim 1 wherein said drum comprises a closure moveable between an open position and a closed position wherein when said closure is moved to said open position free passage of solid particles and fluids into the collecting volume from the treatment volume is permitted and wherein when said closure is moved to said closed position any solid particles and fluids in the treatment volume are retained in the treatment volume.

17. An apparatus as claimed in claim 1 wherein said drum is configured to rotate about an axis which is inclined to the horizontal.

18. An apparatus as claimed in claim 17 wherein a major portion of the treatment volume extends above the collecting volume.

19. An apparatus as claimed in claim 1 wherein said pumping device is arranged in the circulation path external to the drum.

20. An apparatus as claimed in claim 1 wherein said partition divides the internal volume of the drum into two portions respectively located at a first end and a second end.

21. An apparatus as claimed in claim 20 wherein treatment liquor and solid particulate material enter and exit the internal volume of the drum from first and second end regions of the drum.

22. An apparatus as claimed in claim 1 wherein said partition comprises a plurality of apertures.

23. An apparatus as claimed in claim 22 wherein said partition is in the form of a perforate or reticulate screen.

24. An apparatus as claimed in claim 22 wherein said apertures have a maximum dimension of from about 2 to 125 mm, or from about 26 mm to about 125 mm.

25. An apparatus as claimed in claim 1 wherein said partition comprises metal, metal alloy, plastic, fibreglass, composite or polymeric materials.

26. An apparatus as claimed in claim 1 wherein said partition is arranged to be perpendicular to the axis of rotation of said drum and/or wherein said partition is planar.

27. An apparatus as claimed in claim 1 wherein said solid particles can be re-used one or more times for treatment of the animal skin substrate(s) in, with or by the apparatus of the invention.

28. An apparatus as claimed in claim 1 wherein said solid particles have an average particle diameter of from 1 mm to 100 mm and/or wherein said solid particles have a length of from 1 mm to 100 mm.

29. An apparatus as claimed in claim 1 wherein the solid particles comprise a multiplicity of polymeric particles, a multiplicity of non-polymeric particles or a mixture of a multiplicity of polymeric and non-polymeric particles.

30. An apparatus as claimed in claim 1 wherein said drum has a capacity of from 500 to 200,000 liters.

31. An apparatus as claimed in claim 1 wherein said treatment volume comprises at least 50% of said internal volume of said drum.

32. An apparatus as claimed in claim 1 wherein said collecting volume comprises not more than 30% of said internal volume of said drum.

33. A method of separating a multiplicity of solid particles from one or more animal skin substrates during a treatment process comprising:

agitating said animal skin substrates with a multiplicity of solid particles and treatment liquor in a treatment volume of a rotatably mounted drum wherein the side-walls of said drum are not perforate, said drum having a collecting volume separated from the treatment volume by a partition, wherein said method further comprises allowing the solid particles and treatment liquor to pass through the partition from the treatment volume to the collecting volume whilst retaining said animal skin substrates in the treatment volume, and wherein said method is performed using the apparatus as defined in claim 1.

34. The method as claimed in claim 33 comprising circulating said treatment liquor from said collecting volume to said treatment volume to provide a flow of treatment liquor through the treatment volume and continuing agitation of said animal skin substrates in said drum for a predetermined period or until a desired separation of solid particles from said animal skin substrates is achieved.

35. The method as claimed in claim 33 further comprising conveying said solid particles and said treatment liquor from the collecting volume, separating at least a portion of said treatment liquor from said solid particles and re-introducing said solid particles into said treatment volume.

36. The method as claimed in claim 33 comprising the steps of:

i) introducing treatment liquor into said treatment volume and agitating said animal skin substrates with said solid particles and said treatment liquor in the treatment volume for a first agitation step;

ii) allowing said treatment liquor to pass through the partition to the collecting volume and conveying said treatment liquor from the collecting volume along a circulation path;

iii) re-introducing said treatment liquor from said circulation path into said treatment volume.

37. The method as claimed in claim 36 further comprising separating at least a portion of said treatment liquor received from the collecting volume from said solid particles before re-introducing said treatment liquor from said circulation path into said treatment volume.

38. The method as claimed in claim 36 further comprising extracting effluent and/or unwanted matter from the treatment liquor received from the collecting volume before re-introducing said treatment liquor from said circulation path into said treatment volume.

39. The method of as claimed in claim 33 comprising the steps of:

i) introducing said solid particles into said treatment volume and agitating said animal skin substrates with said solid particles and said treatment liquor in the treatment volume for a first agitation step;

ii) allowing said solid particles to pass through the partition to the collecting volume and conveying said solid particles from the collecting volume along a circulation path;

iii) re-introducing said solid particles into said treatment volume from said circulation path and agitating said animal skin substrates with said solid particles and treatment liquor in the treatment volume for a subsequent agitation step.

40. The method as claimed in claim 39 further comprising separating at least a portion of said treatment liquor from said solid particles before re-introducing said solid particles from said circulation path into said treatment volume for said subsequent agitation step.

41. The method as claimed in claim 33 further comprising subjecting said solid particles to a cleaning operation using a cleaning formulation before re-introducing said solid particles into said treatment volume for a subsequent agitation step.

42. The method as claimed in claim 41 comprising conveying said solid particles from the collecting volume to a processing system and performing said cleaning operation in said processing system.

43. The method as claimed in claim 41 comprising draining said treatment liquor from the drum and subjecting said solid particles to said cleaning operation within said drum before re-introducing said solid particles into said treatment volume for a subsequent agitation step.

44. The method as claimed in claim 33 wherein said drum comprises a closure moveable between an open position and a closed position wherein when said closure is moved to said open position free passage of solid particles and fluids to the collecting volume from the treatment volume is permitted and wherein when said closure is moved to said closed position solid particles are prevented from passing into the collecting volume from the treatment volume whilst the passage of fluids to the collecting volume from the treatment volume is permitted, wherein said method comprises moving said closure from said open position to said closed position or moving said closure from said closed position to said open position at one or more points during the treatment process.

45. The method as claimed in claim 33 wherein said drum comprises a closure moveable between an open position and a closed position wherein when said closure is moved to said open position free passage of solid particles and fluids into the collecting volume from the treatment volume is permitted and wherein when said closure is moved to said closed position any solid particles and fluids in the treatment volume are retained in the treatment volume, wherein said method comprises agitating said animal skin substrate(s) and said solid particles in said drum for a predetermined period with said closure in a closed position and moving said closure to an open position when said predetermined period has elapsed.

46. The method as claimed in claim 45 wherein said method further comprises introducing treatment liquor into said drum when said predetermined period has elapsed.

47. The method as claimed in claim 33 wherein said drum is caused to rotate about an axis which is inclined to the horizontal for at least a portion of said treatment process.

48. The method as claimed in claim 33 wherein said drum is caused to rotate at a speed of from about 1 to about 50 rpm, or from about 1 to about 15 rpm.

49. The method as claimed in claim 33 wherein said treatment volume has an ullage volume of at least 10% by volume.

50. The method as claimed in claim 33 wherein the or each animal skin substrate is a hide or pelt.

51. The method as claimed in claim 33 wherein said treatment process is a tannery process.

52. The method as claimed in claim 33 wherein said treatment process is a process used in the production of leather.

53. The method as claimed in claim 33 wherein said treatment liquor is aqueous.

54. The method as claimed in claim 33 wherein said treatment liquor in the drum is free from water except for that originating from the or each animal substrate.

55. The method as claimed in claim 33 wherein said treatment liquor comprises at least one treatment agent selected from tanning agents, re-tanning agents and tannery process agents.

56. The method as claimed in claim 33 wherein said treatment liquor comprises at least one colourant.

57. The method as claimed in claim 56 wherein said colourant is selected from one or more dyes, pigments, optical brighteners or mixtures thereof.

58. The method as claimed in claim 33 wherein said solid particles are re-used one or more times in the same treatment method or for the treatment of further animal skin substrates in subsequent treatments according to the method.

59. A method as claimed in claim 33 wherein said rotatably mounted drum comprises an internal volume having a first portion defining said treatment volume for retaining said animal substrates and a second portion defining said collecting volume.

60. A method as claimed in claim 33 wherein said partition divides the internal volume of the drum into two portions respectively located at a first end and a second end.

61. A method as claimed in claim 33 wherein said partition is arranged to be perpendicular to the axis of rotation of said drum and/or wherein said partition is planar.

62. A method of treating one or more animal skin substrates wherein said method comprises the method of claim 33.

63. A method as claimed in claim 60 wherein treatment liquor and solid particulate material enter and exit the internal volume of the drum from the first and second end regions of the drum.

* * * * *